US010451363B2

(12) United States Patent
Eskew et al.

(10) Patent No.: US 10,451,363 B2
(45) Date of Patent: Oct. 22, 2019

(54) BRACKET ASSEMBLY FOR A HEAT EXCHANGER

(71) Applicant: Johnson Controls Technology Company, Plymouth, MI (US)

(72) Inventors: Robert L. Eskew, Kingman, KS (US); Frank D. Ashby, Wichita, KS (US); Tony M. Clark, Wichita, KS (US); Jeremiah M. Horn, Derby, KS (US); Debra S. Yates, Wichita, KS (US); Cody J. Kaiser, Wichita, KS (US); Hung V. Tran, Maize, KS (US); Dale Clair Kester, Wichita, KS (US); Stanley Robert Buisman, Denton, TX (US); Bennie Hoyt, Benton, KS (US)

(73) Assignee: Johnson Controls Technology Company, Auburn Hills, MI (US)

( * ) Notice: Subject to any disclaimer, the term of this patent is extended or adjusted under 35 U.S.C. 154(b) by 149 days.

(21) Appl. No.: 15/398,599

(22) Filed: Jan. 4, 2017

(65) Prior Publication Data

US 2017/0205158 A1 Jul. 20, 2017

Related U.S. Application Data

(60) Provisional application No. 62/279,286, filed on Jan. 15, 2016.

(51) Int. Cl.
*F24F 1/16* (2011.01)
*F28F 9/013* (2006.01)
(Continued)

(52) U.S. Cl.
CPC ..... *F28F 9/013* (2013.01); *F24F 1/16* (2013.01); *F28D 1/0471* (2013.01); *F28F 9/0243* (2013.01); *F28D 2021/007* (2013.01)

(58) Field of Classification Search
CPC ..... F28F 9/013; F28F 9/024; F28F 9/0023; F28F 9/007; F28F 2275/08;
(Continued)

(56) References Cited

U.S. PATENT DOCUMENTS 6,390,180 B1 * 5/2002 Olsen ..... F28F 9/002 165/125
2003/0230397 A1 * 12/2003 Southwick ..... B60K 11/04 165/67

(Continued)

*Primary Examiner* — Travis C Ruby
(74) *Attorney, Agent, or Firm* — Fletcher Yoder, P.C.

(57) ABSTRACT

A bracket system includes a first bracket configured to couple a heat exchanger coil to a base of a heat exchanger via engagement of a mounting surface of the base, where the first bracket has a recessed member and a fastening tab, and a second bracket configured to couple the heat exchanger coil to a shroud of the heat exchanger via engagement of a fastener, where the second bracket has a protruding member and a protruding ridge. The recessed member is configured to receive the protruding member such that the first bracket and the second bracket are coupled to one another in a first configuration of the bracket system, and where the fastening tab is configured to receive the protruding ridge such that the first bracket and the second bracket are coupled to one another in a second configuration of the bracket system.

18 Claims, 16 Drawing Sheets

(51) Int. Cl.
*F28F 9/02* (2006.01)
*F28D 1/047* (2006.01)
*F28D 21/00* (2006.01)

(58) Field of Classification Search
CPC ..... F28F 2275/085; F28F 2275/14; F28F 2275/143; F28F 2275/146; F28F 2280/00; F28F 2280/02; F24F 1/16; F24F 1/56; F28D 1/0471; F28D 2021/007
See application file for complete search history.

(56) References Cited

U.S. PATENT DOCUMENTS

2004/0188061 A1* 9/2004 Beck ..... B60K 11/04 165/67
2004/0261973 A1* 12/2004 Kent ..... F28F 9/002 165/67
2011/0174013 A1* 7/2011 Moraes ..... F24F 1/16 62/498
2014/0091692 A1* 4/2014 Miwa ..... F24F 13/20 312/285
2015/0047808 A1* 2/2015 Takahashi ..... F28F 9/02 165/67

* cited by examiner

FIG. 1
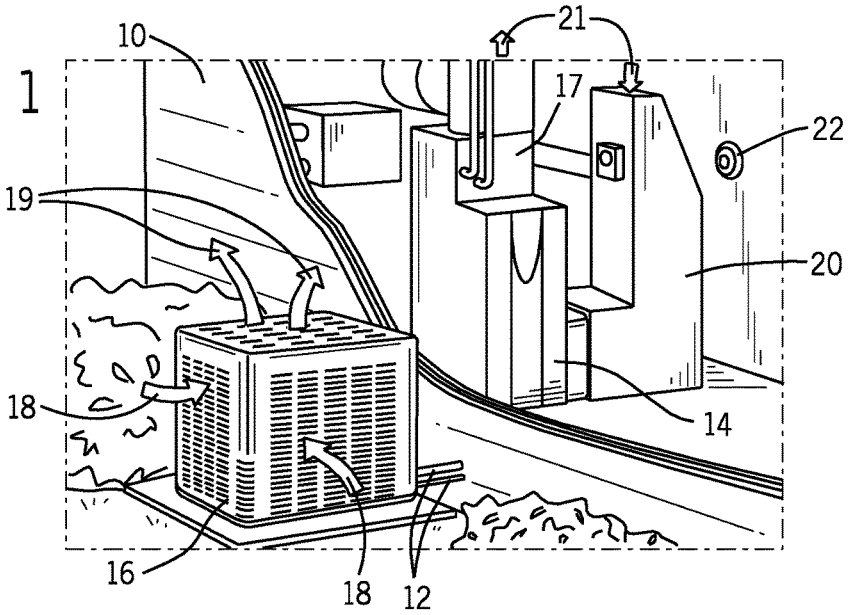
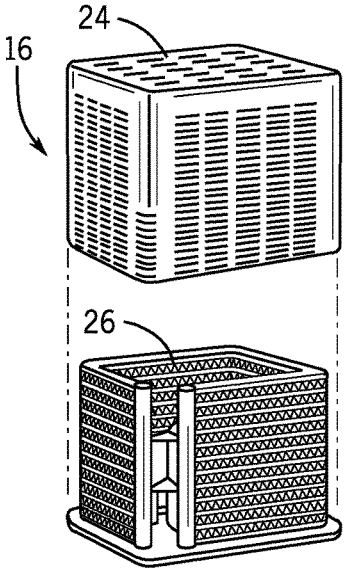
FIG. 2
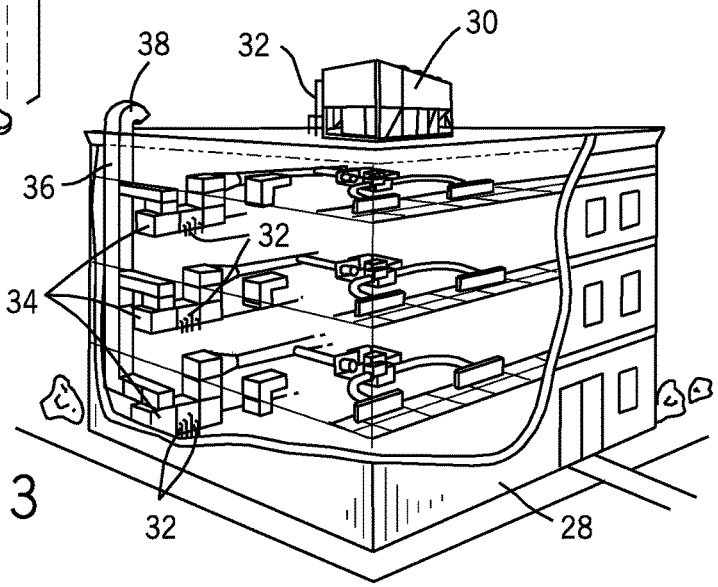
FIG. 3

FIG. 21
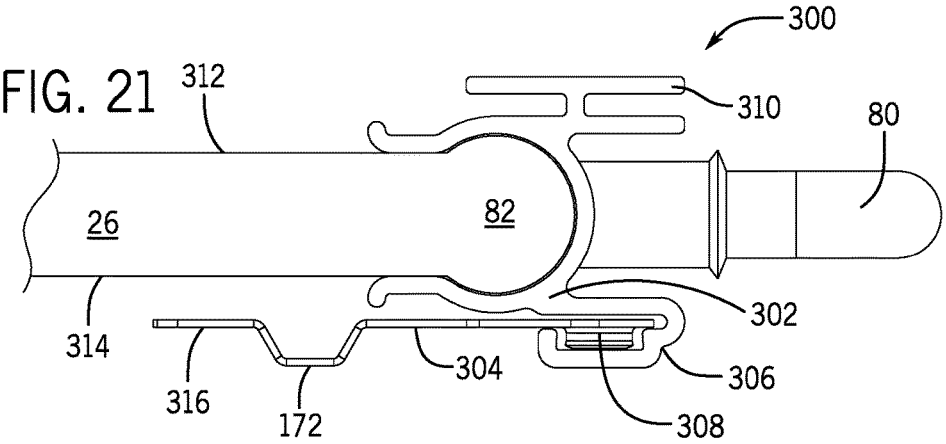
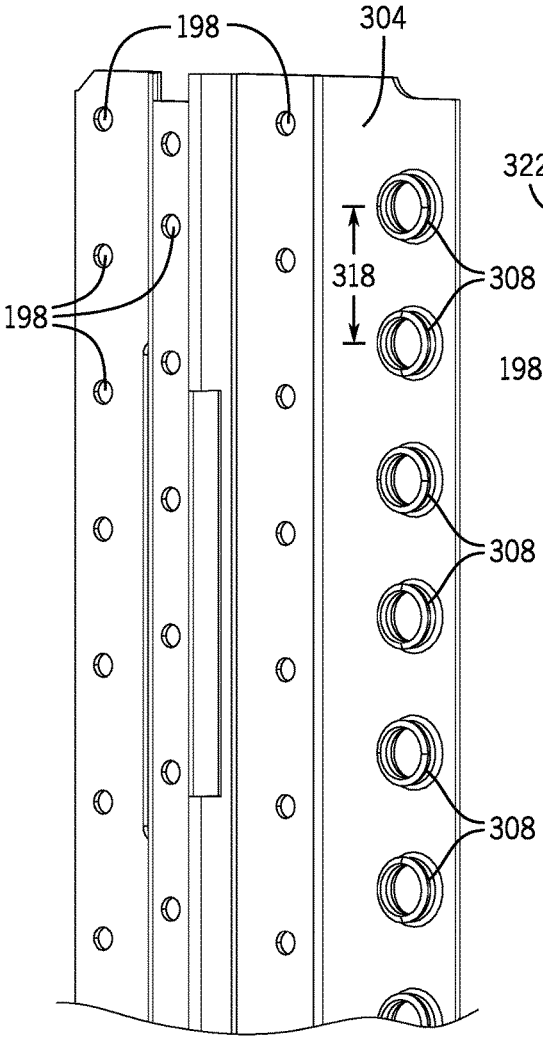
FIG. 22
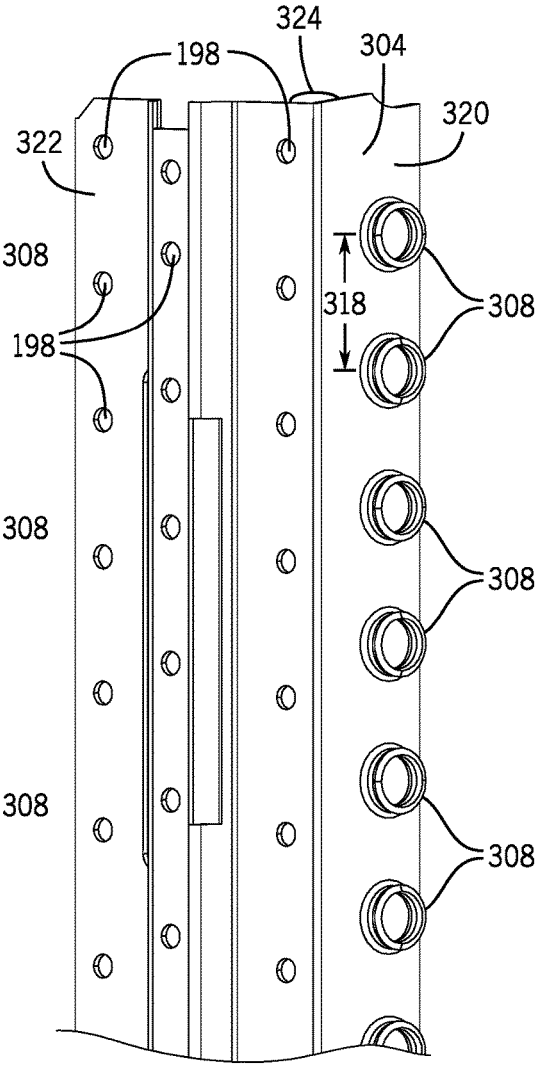
FIG. 23

BRACKET ASSEMBLY FOR A HEAT EXCHANGER

CROSS REFERENCE TO RELATED APPLICATIONS

This application claims priority from and the benefit of U.S. Provisional Application Ser. No. 62/279,286, filed Jan. 15, 2016, entitled "BRACKET ASSEMBLY FOR A HEAT EXCHANGER," the disclosure of which is hereby incorporated by reference in its entirety for all purposes.

BACKGROUND

The present disclosure relates generally to a bracket assembly for mounting a heat exchanger coil. Specifically, the disclosure relates to a multi-bracket coil mount.

Heat exchangers are used in a variety of settings and for many purposes. For example, liquid-to-air heat exchangers are used throughout industry, and in many heating, ventilating, air conditioning, and refrigeration applications. The latter applications include residential, commercial, and industrial air conditioning systems in which heat exchangers serve as both condensers and evaporators in a thermal cycle. In general, when used as an evaporator, liquid or primarily liquid refrigerant enters a heat exchanger and is evaporated to draw thermal energy from an air flow stream that is drawn over the heat exchanger tubes and fins. When used as a condenser, the refrigerant enters in a vapor phase (or a mixed phase) and is de-superheated, condensed, and sub-cooled in the condenser.

In some cases, manufacturing processes may result in heat exchanger coils with varying geometries and/or shapes because of manufacturing imperfections (e.g., engineering tolerances). Additionally, it may be undesirable to couple a heat exchanger coil to a cover or shroud surrounding the heat exchanger coil due to such components having different materials. Accordingly, it is now recognized that it may be desirable to facilitate an assembly process of a heat exchanger with improved hardware.

DRAWINGS

FIG. 1 is a perspective view of a residential air conditioning or heat pump system that utilizes a heat exchanger, in accordance with an aspect of the present disclosure;

FIG. 2 is a partially exploded view of an outdoor unit of the system of FIG. 1, in accordance with an aspect of the present disclosure;

FIG. 3 is a perspective view of a commercial or industrial system using a heat exchanger and air handlers to cool a building, in accordance with an aspect of the present disclosure;

Figure 6:
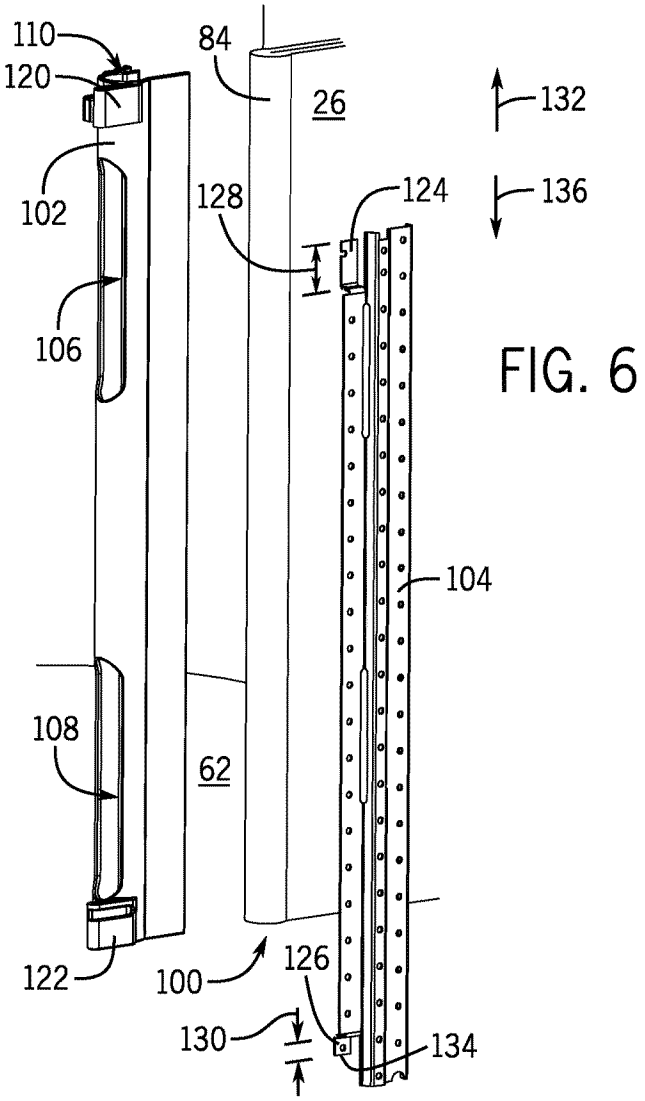
FIG. 6 is an exploded view of a second header of the coil of the outdoor unit of FIGS. 1 and 2 having the multi-bracket coil mount, in accordance with an aspect of the present disclosure.
Figure 5:
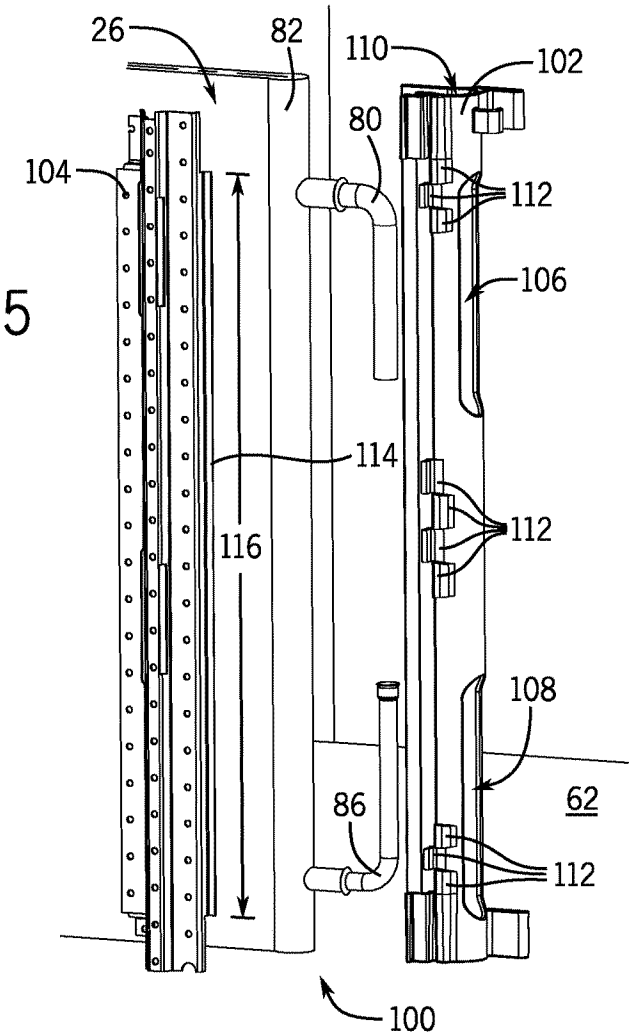
FIG. 5 is an exploded view of a first header of a coil of the outdoor unit of FIGS. 1 and 2 having a multi-bracket coil mount, in accordance with an aspect of the present disclosure.
Figure 7:
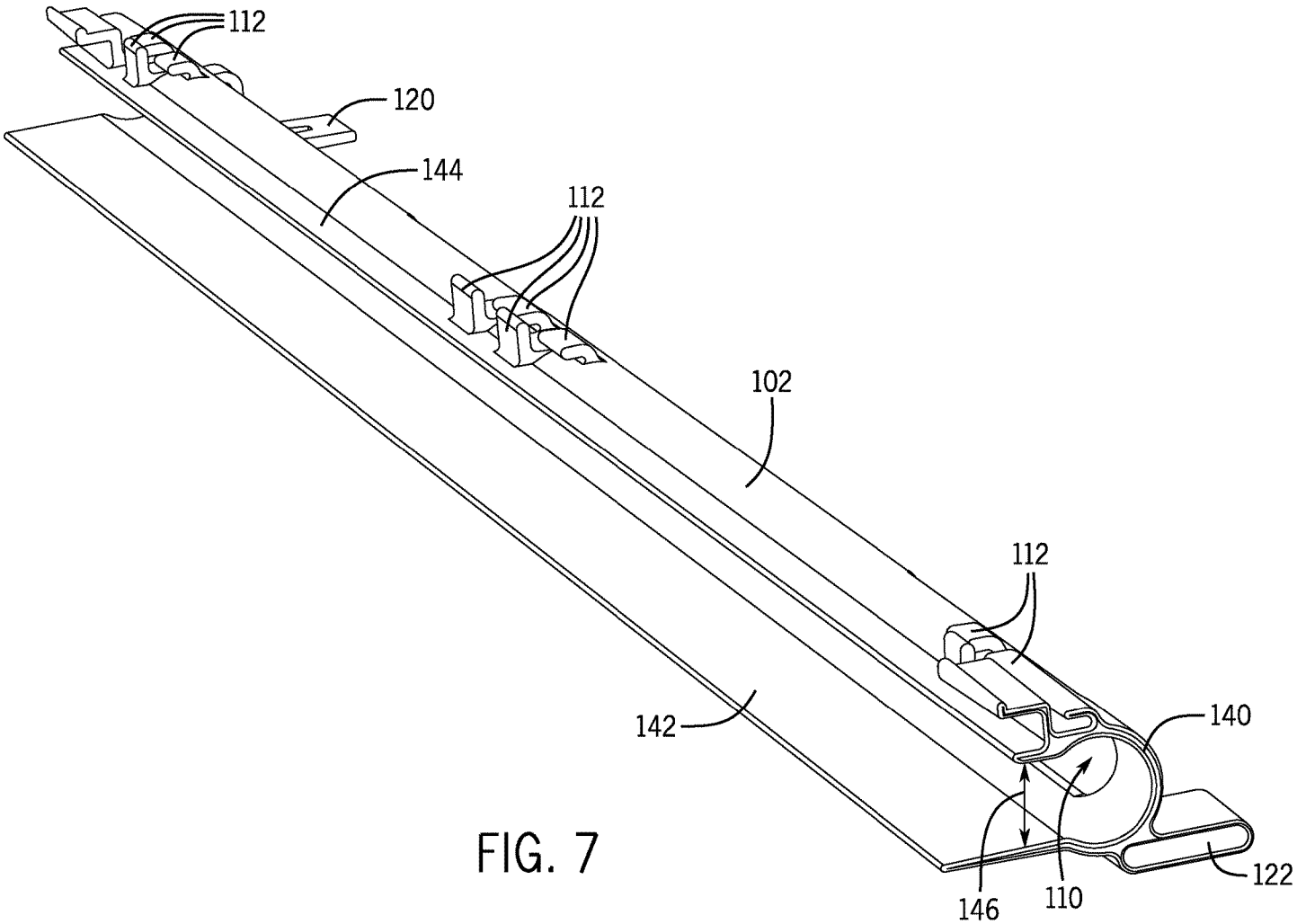
FIG. 7 is a perspective view of a flexible bracket of the multi-bracket coil mount of FIGS. 5 and 6, in accordance with an aspect of the present disclosure.
Figure 8:
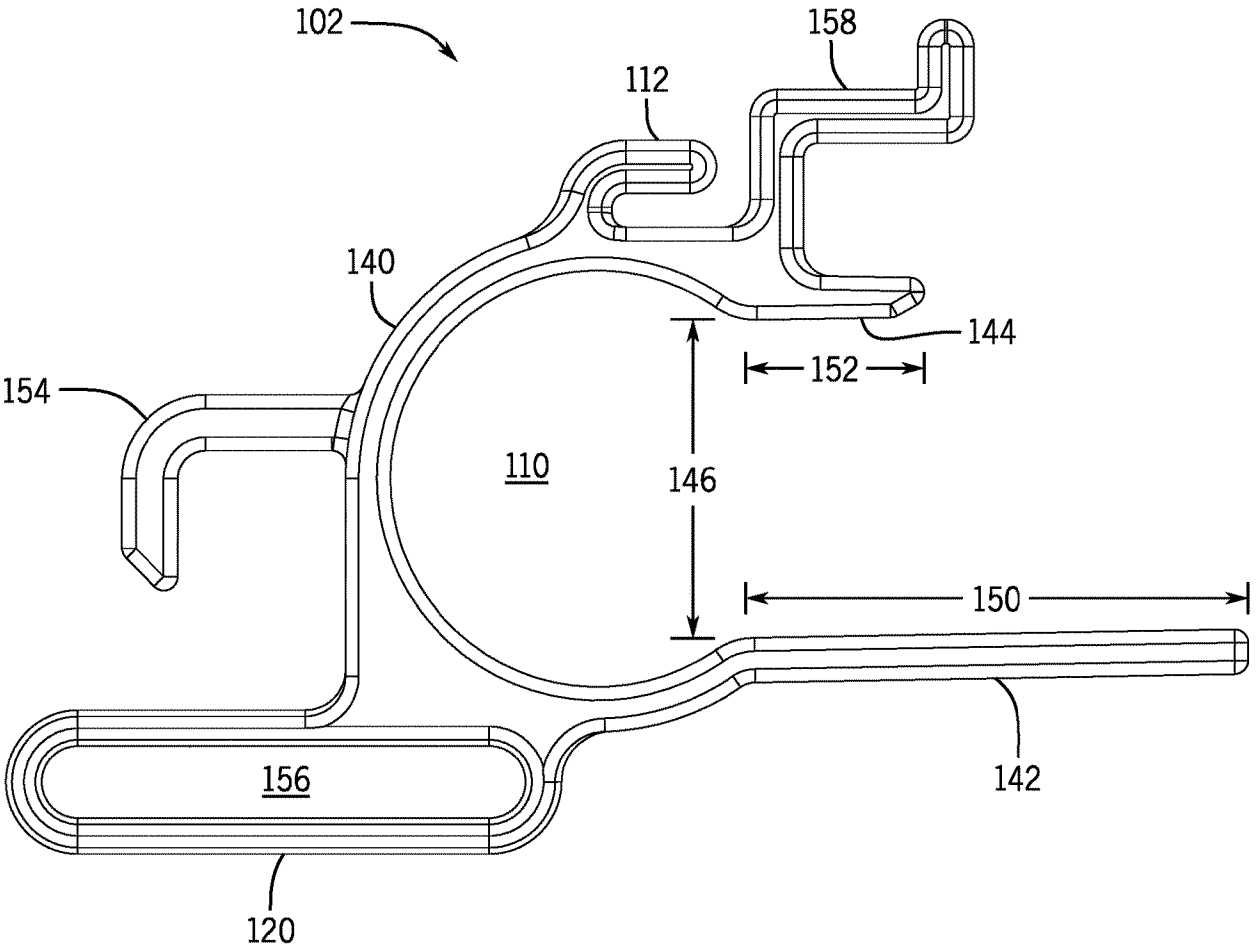
FIG. 8 is a cross-sectional, end-on view of the flexible bracket of FIG. 7, in accordance with an aspect of the present disclosure.
Figure 9:
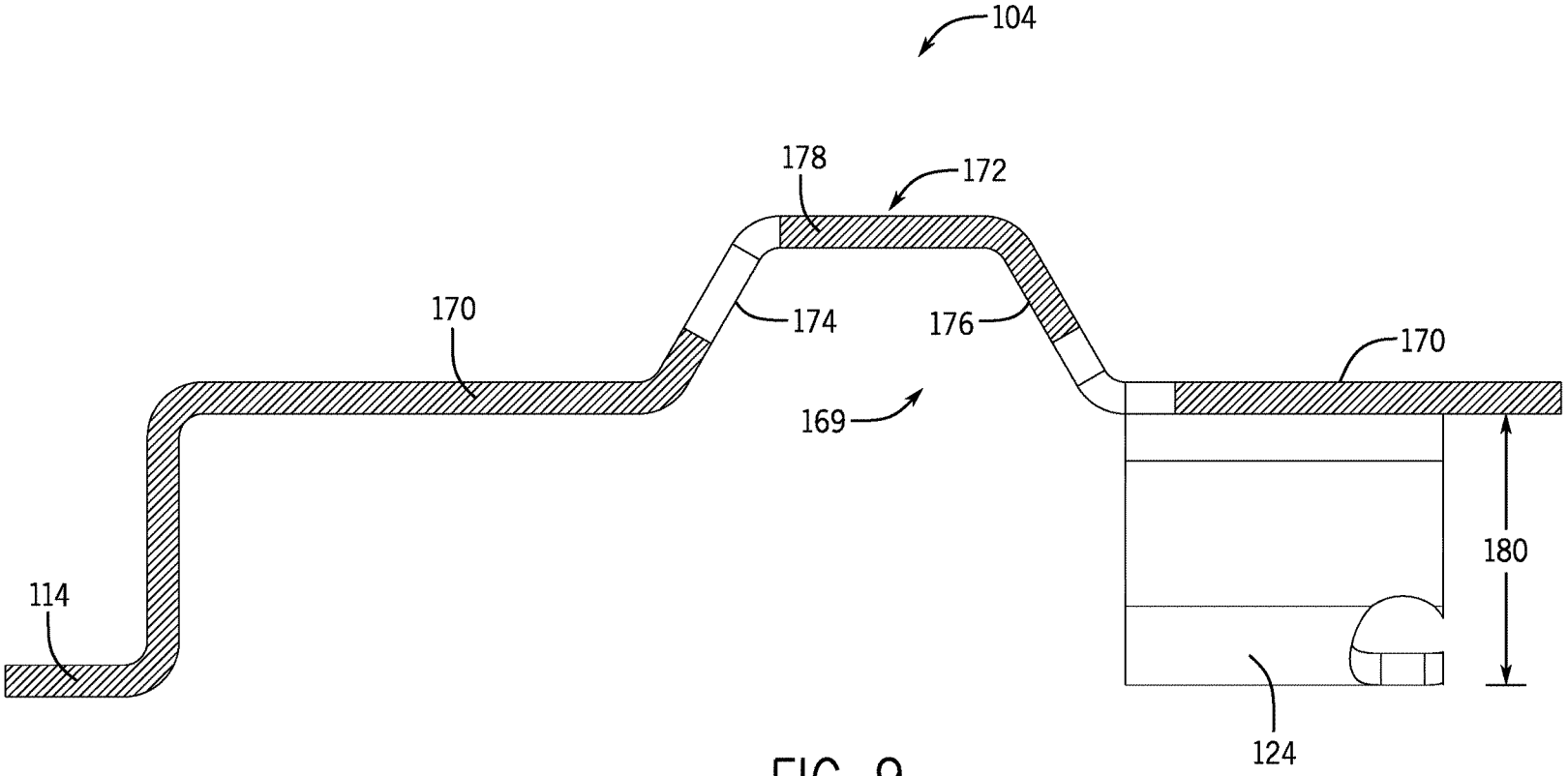
FIG. 9 is a cross-sectional view of a first end of a rigid bracket of the multi-bracket coil mount of FIGS. 5 and 6, in accordance with an aspect of the present disclosure.
Figure 10:
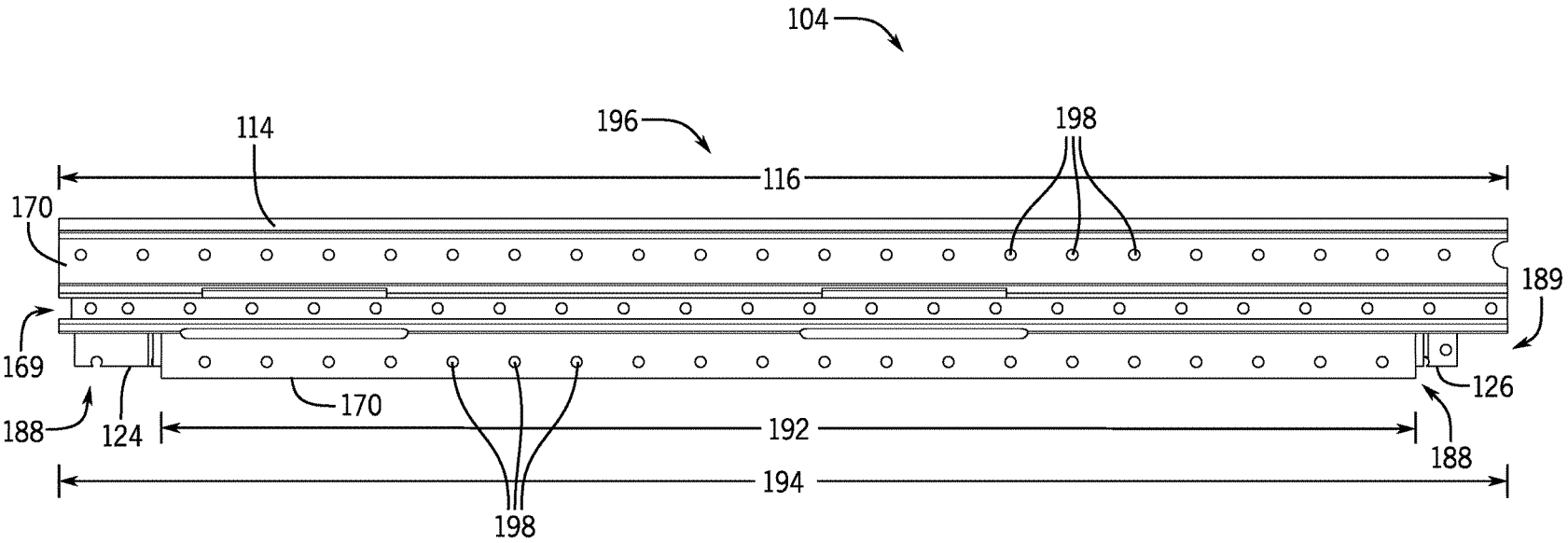
FIG. 10 is a top view of the rigid bracket of FIG. 9, in accordance with an aspect of the present disclosure.
Figure 11:
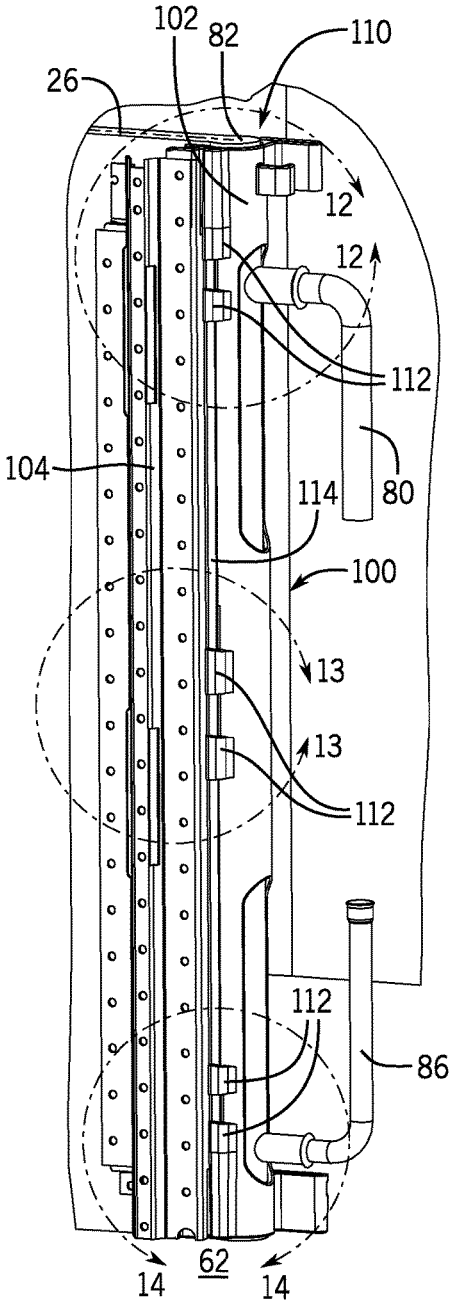
Figure 12:
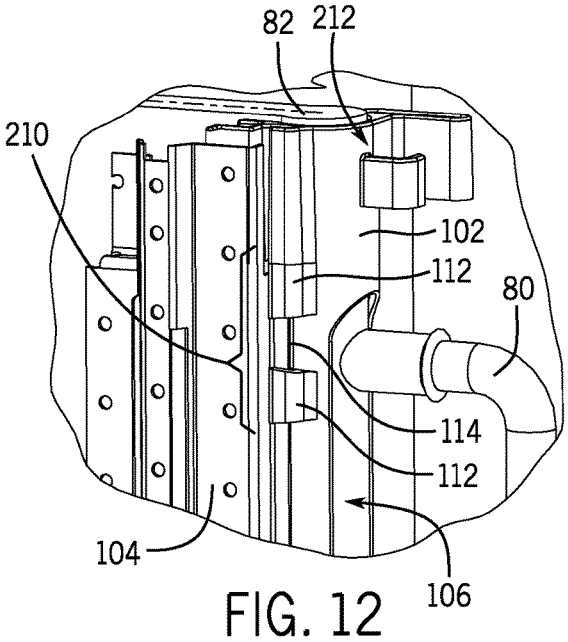
Figure 13:
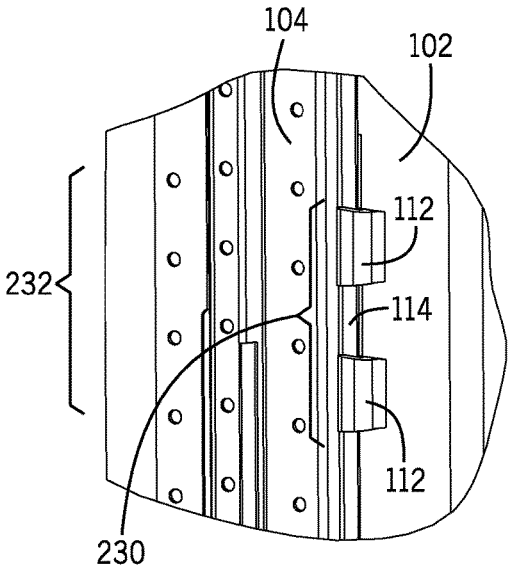
Figure 14:
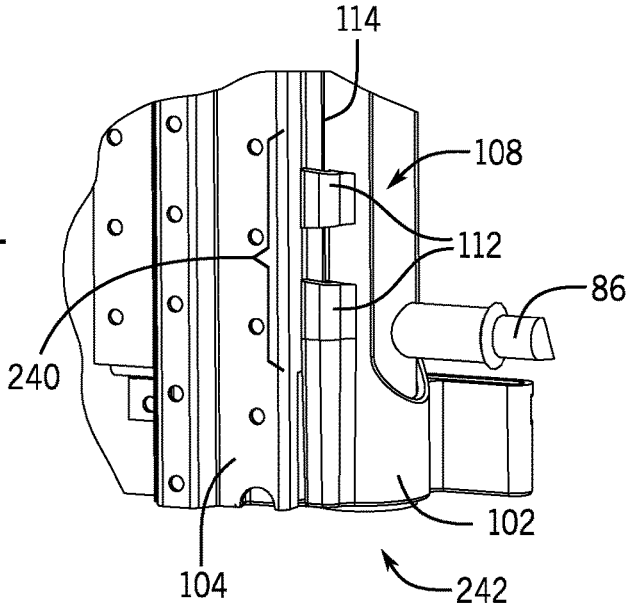
Figure 15:
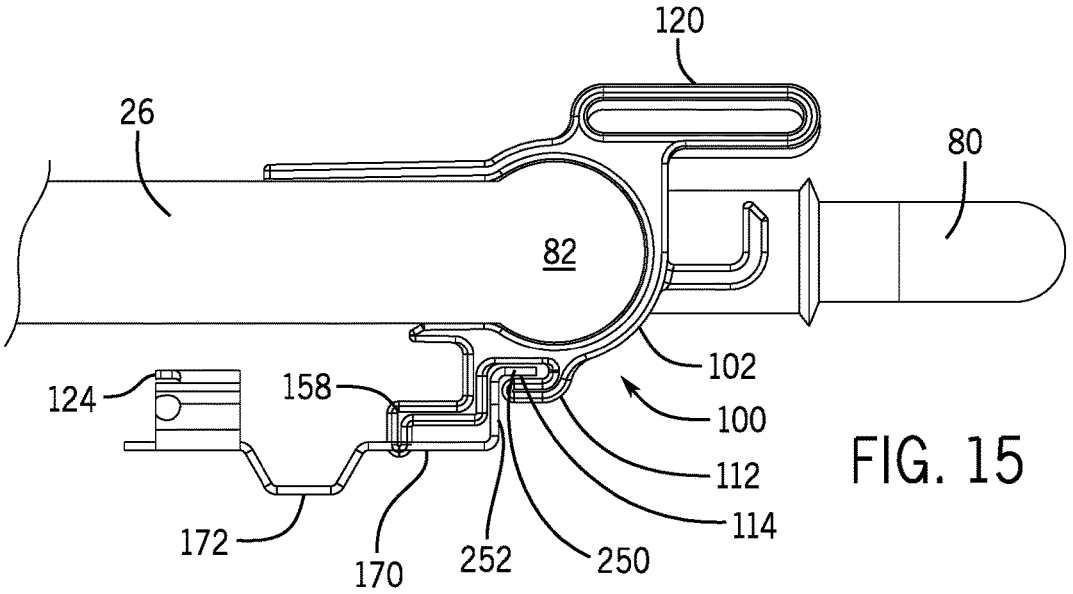
Figure 16:
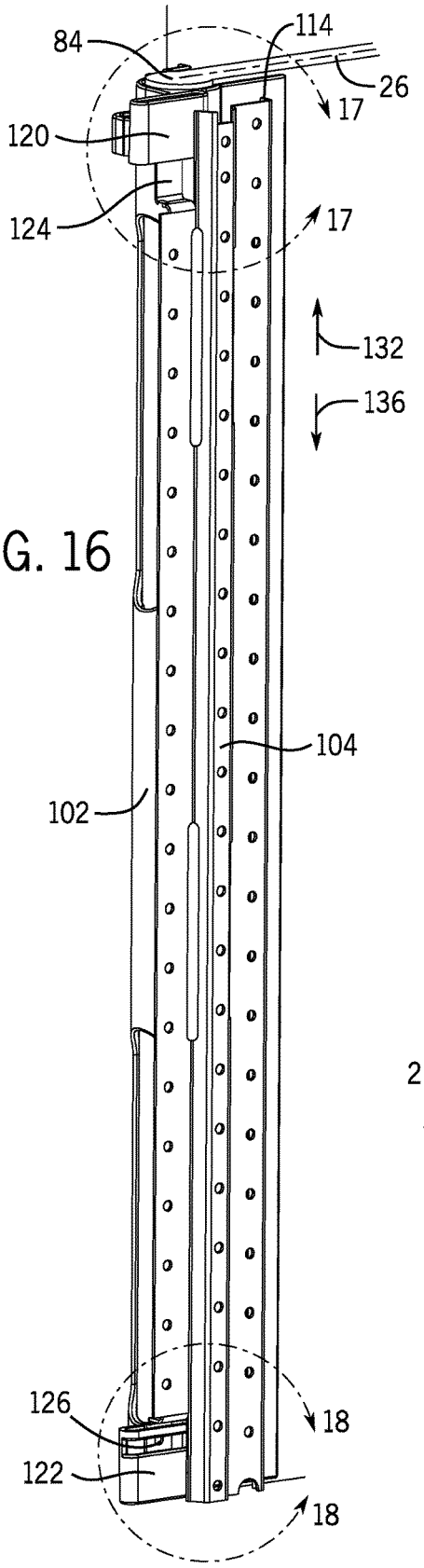
Figure 17:
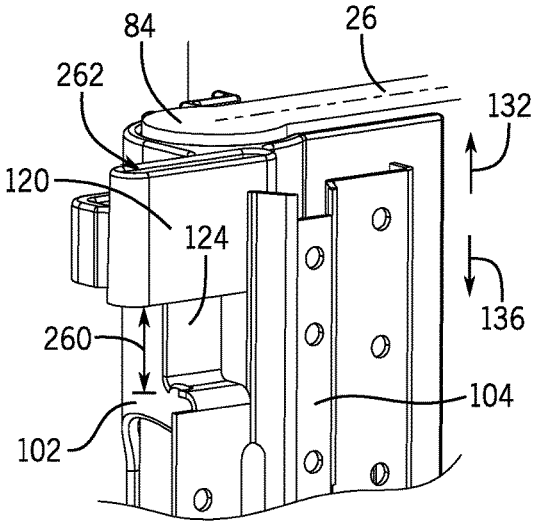
Figure 18:
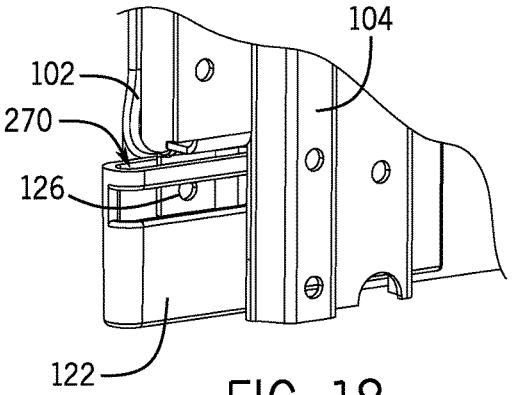
Figure 19:
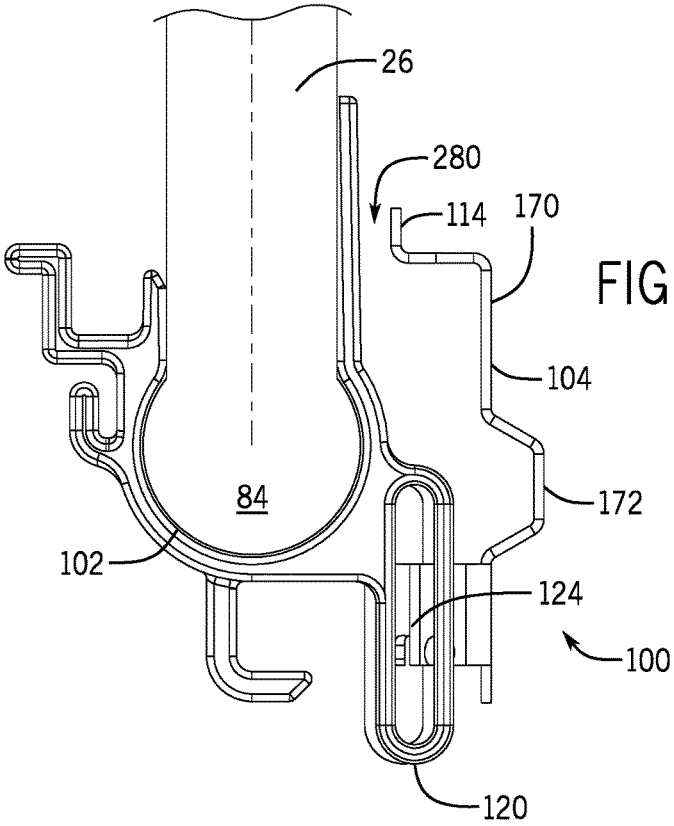
Figure 20:
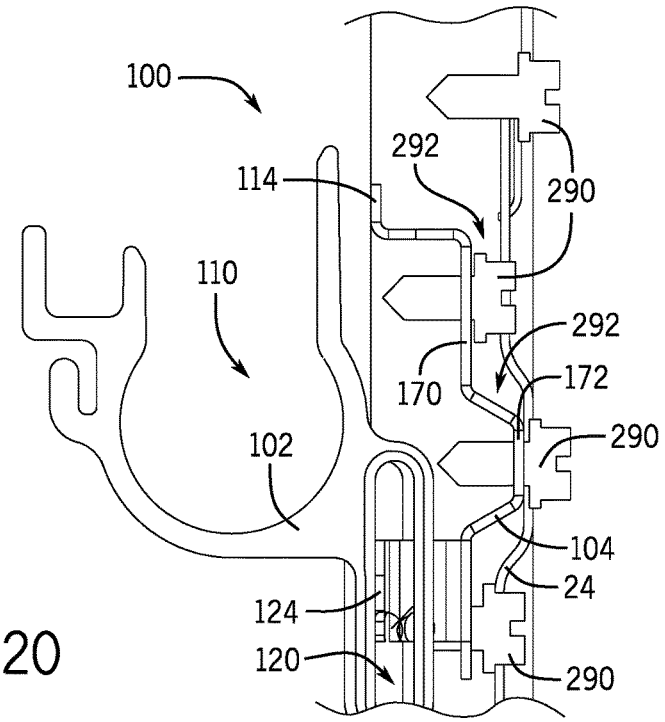
Figure 24:
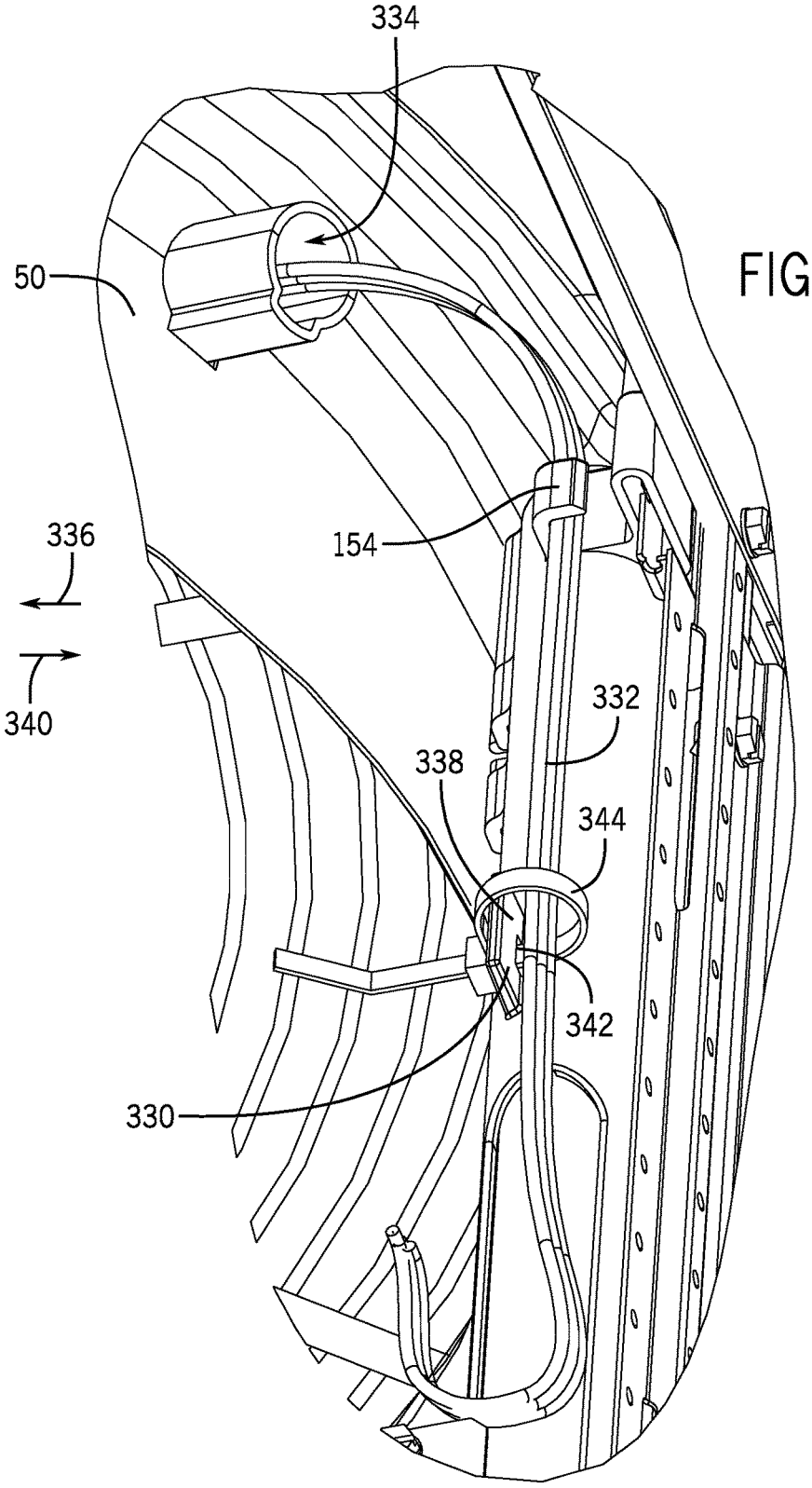
Figure 28:
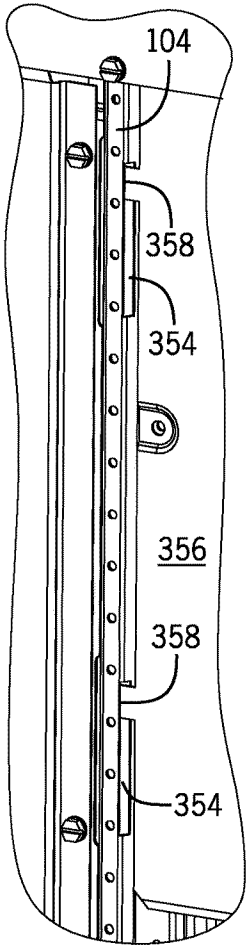
Figure 27:
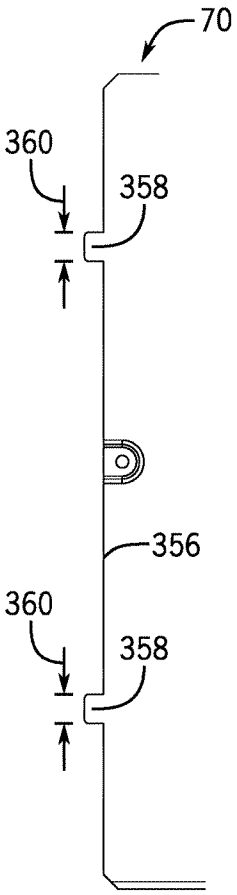
Figure 26:
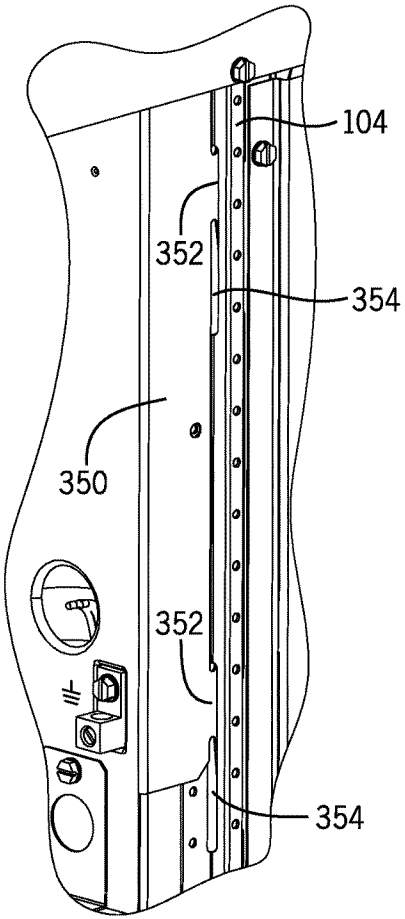
Figure 25:
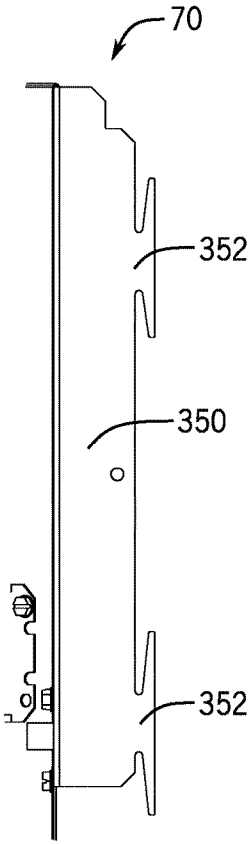
Figure 29:
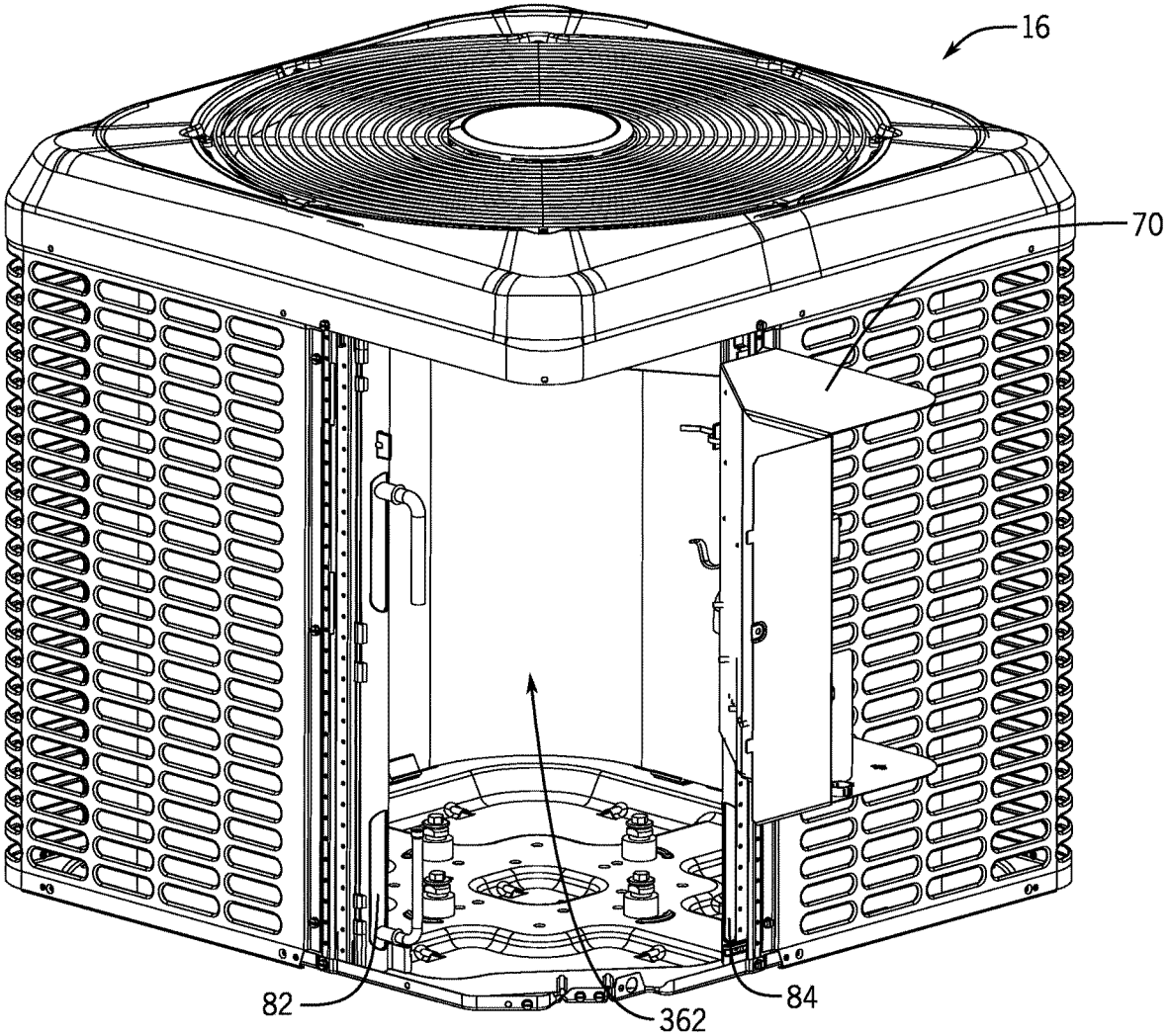
Figure 30:
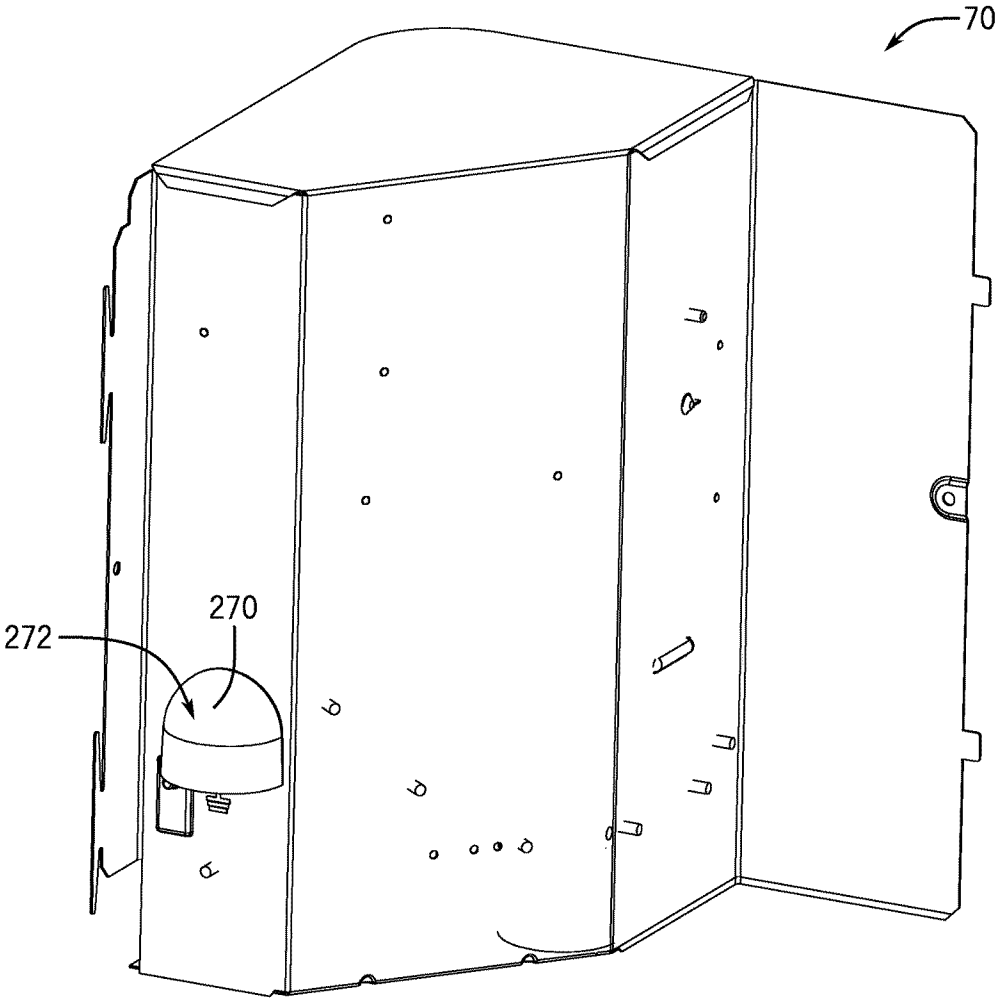

FIG. 11 is a perspective view of the flexible bracket of FIGS. 7 and 8 coupled to the first header of the coil of the outdoor unit of FIGS. 1 and 2, as well as the rigid bracket of FIGS. 9 and 10 secured to the flexible bracket, in accordance with an aspect of the present disclosure;

FIG. 12 is a close-up perspective view of a connection between a protruding ridge of the rigid bracket of FIGS. 9 and 10 and a first set of fastening tabs on a first end of the flexible bracket of FIGS. 7 and 8, in accordance with an aspect of the present disclosure;

FIG. 13 is a close-up perspective view of a connection between the protruding ridge of FIG. 12 and a second set of fastening tabs located on a middle portion of the flexible bracket of FIGS. 7 and 8, in accordance with an aspect of the present disclosure;

FIG. 14 is a close-up perspective view of a connection between the protruding ridge of FIGS. 12 and 13 and a third set of fastening tabs located on a second end of the flexible bracket of FIGS. 7 and 8, in accordance with an aspect of the present disclosure;

FIG. 15 is a cross-sectional top-end view of the multi-bracket coil mount of FIGS. 5 and 6 coupled to the coil of the outdoor unit of FIGS. 1 and 2, in accordance with an aspect of the present disclosure;

FIG. 16 is a perspective view of the flexible bracket of FIGS. 7 and 8 coupled to a second header of the coil of the outdoor unit of FIGS. 1 and 2, as well as the flexible bracket of FIGS. 7 and 8 coupled to the rigid bracket of FIGS. 9 and 10, in accordance with an aspect of the present disclosure;

FIG. 17 is a close-up perspective view of a connection between a first protruding member of the rigid bracket of FIGS. 9 and 10 and a first recessed member of the flexible bracket of FIGS. 7 and 8, in accordance with an aspect of the present disclosure;

FIG. 18 is a close-up perspective view of a connection between a second protruding member of the rigid bracket of FIGS. 9 and 10 and a second recessed member of the flexible bracket of FIGS. 7 and 8, in accordance with an aspect of the present disclosure;

FIG. 19 is a cross-sectional, top-end view of the multi-bracket coil mount of FIGS. 5 and 6, in accordance with an aspect of the present disclosure;

FIG. 20 is a cross sectional view of the multi-bracket coil mount of FIGS. 5 and 6 coupled to a shroud of the outdoor unit of FIGS. 1 and 2, in accordance with an aspect of the present disclosure;

FIG. 21 is a cross sectional top-end view of another multi-bracket coil mount coupled to the first header of the coil of the outdoor unit of FIGS. 1 and 2, in accordance with an aspect of the present disclosure;

FIG. 22 is a perspective view of a rigid bracket of the multi-bracket coil mount of FIG. 21, in accordance with an aspect of the present disclosure;

FIG. 23 is a perspective view of an embodiment of the rigid bracket of the multi-bracket coil mount of FIG. 21, in accordance with an aspect of the present disclosure;

FIG. 24 is a perspective view of a flexible bracket having a hook and a coupling member for guiding a wire in the outdoor unit of FIGS. 1 and 2, in accordance with an aspect of the present disclosure;

FIG. 25 is a side view of a first wall of a control box of the outdoor unit of FIGS. 1 and 2 having braces to couple the control box to the multi-bracket coil mount, in accordance with an aspect of the present disclosure;

FIG. 26 is a perspective view of the braces of the control box of FIG. 25 inserted into slots of the rigid bracket of the multi-bracket coil mount, in accordance with an aspect of the present disclosure;

FIG. 27 is a second wall of the control box of FIG. 25 having tabs, in accordance with an aspect of the present disclosure;

FIG. 28 is a perspective view of the tabs of FIG. 27 inserted into the slots of the rigid bracket of FIG. 26, in accordance with an aspect of the present disclosure;

FIG. 29 is a perspective view of the outdoor unit of FIGS. 1 and 2 with the control box of FIG. 25 in an open position, in accordance with an aspect of the present disclosure; and FIG. 30 is a perspective view of the control box of FIG. 25 having a rain guard, in accordance with an aspect of the present disclosure.

DETAILED DESCRIPTION

The present disclosure is directed to a multi-bracket coil mount for securing a heat exchanger coil to a base of a heat exchanger as well as to a shroud (e.g., a housing), for example. In some cases, a geometry and/or shape of a heat exchanger coil may vary as a result of manufacturing imperfections (e.g., engineering tolerances). Additionally, it may be undesirable to directly couple the heat exchanger coil to the shroud using mechanical fasteners (e.g., screws) because doing so may cause damage to the heat exchanger coil. Accordingly, it may be desirable to utilize a mounting device that includes a relatively pliable material (e.g., plastic), such that a flexible connection may be established between a heat exchanger coil and a heat exchanger base, for example. However, the heat exchanger coil is generally covered by a cover (e.g., a shroud, a housing, a lid) that protects the heat exchanger coil as well as other components included in the heat exchanger itself from debris, rain, and/or other undesirable contaminants. In some cases, the cover may include a rigid and durable material (e.g., metal) configured to adequately protect the heat exchanger coil and other heat exchanger components. However, it may be undesirable to couple the rigid and durable material to the pliable material that couples the heat exchanger coil to the heat exchanger base. Therefore, it is now recognized that a multi-bracket coil mount that includes a first bracket having the pliable material (e.g., plastic) and a second bracket having the rigid and durable material (e.g., a metallic material) may be desirable for assembling a heat exchanger.

Turning now to the figures, FIGS. 1 through 3 depict exemplary applications for heat exchangers. Such systems, in general, may be applied in a range of settings, both within the heating, ventilating, air conditioning, and refrigeration (HVAC&R) field and outside of that field. In presently contemplated applications, however, heat exchangers may be used in residential, commercial, light industrial, industrial, and/or in any other application for heating or cooling a volume or enclosure, such as a residence, building, structure, and so forth. Moreover, the heat exchangers may be used in industrial applications, where appropriate, for basic refrigeration and heating of various fluids. FIG. 1 illustrates a residential heating and cooling system. In general, a residence 10 may include refrigerant conduits 12 that operatively couple an indoor unit 14 to an outdoor unit 16. The indoor unit 14 may be positioned in a utility room, an attic, a basement, or other location. The outdoor unit 16 is typically situated adjacent to a side of the residence 10 and is covered by a shroud to protect the system components and to prevent contaminants (e.g., dirt, leaves, rain) from entering the unit 16. The refrigerant conduits 12 may transfer refrigerant between the indoor unit 14 and the outdoor unit 16, typically transferring primarily liquid refrigerant in one direction and primarily vaporized refrigerant in an opposite direction.

When the system shown in FIG. 1 is operating as an air conditioner, a coil in the outdoor unit 16 (e.g., outdoor coil) may serve as a condenser for re-condensing vaporized refrigerant flowing from the indoor unit 14 to the outdoor unit 16 via one of the refrigerant conduits 12. In these applications, an evaporator coil 17 of the indoor unit 14 may receive liquid refrigerant (which may be expanded by an expansion device, not shown) and evaporate the refrigerant before returning it to the outdoor unit 16.

The outdoor unit 16 may draw in ambient air through its sides as indicated by arrows 18 directed to the sides of the unit 16, force the air through the outer unit coil (e.g., outdoor coil) by a means of a fan (not shown), and expel the air as indicated by arrows 19 above the outdoor unit 16. When operating as an air conditioner, the air may be heated by the coil (e.g., outdoor coil) within the outdoor unit 16 and exit the top of the unit 16 at a temperature higher than when it entered the sides. Air may be blown over indoor coil 17 and then circulated through residence 10 by means of ductwork 20, as indicated by arrows 21 entering and exiting the ductwork 20. The overall system operates to maintain a desired temperature as set by a thermostat 22, for example. When the temperature sensed inside the residence is higher than the set point on the thermostat (plus a small amount), the air conditioner may operate to refrigerate additional air for circulation through the residence 10. When the temperature reaches the set point (minus a small amount), the unit may stop the refrigeration cycle temporarily.

When the unit 16 in FIG. 1 operates as a heat pump, the roles of the coils may simply be reversed. That is, the coil of outdoor unit 16 (e.g., outdoor coil) may serve as an evaporator to evaporate refrigerant and thereby cool air entering the outdoor unit 16 as the air passes over the outdoor unit coil. Additionally, the indoor coil 17 may receive a stream of air blown over it and heat the air by condensing a refrigerant.

FIG. 2 illustrates a partially exploded view of the outdoor unit 16 shown in FIG. 1. In general, the outdoor unit 16 may include an upper assembly made up of a shroud 24, a fan assembly, a fan drive motor, and so forth. In the illustrated embodiment of FIG. 2, the fan and fan drive motor are not visible because they are hidden by the surrounding shroud 24. An outdoor coil 26 is housed within the shroud 24 and may generally surround, or at least partially surround, other system components, such as a compressor, an expansion device, and/or a control circuit.

FIG. 3 illustrates another application of presently disclosed embodiments, in this case an HVAC&R system for building environmental management. A building 28 may be cooled by a system that includes a chiller 30 (e.g., the outdoor unit 16 and/or the indoor unit 14), which is typically disposed on or near the building, or in an equipment room or basement. The chiller 30 may be an air-cooled device that implements a refrigeration cycle to cool water, for example.

The water (e.g., refrigerant) may then be circulated to the building 28 through water conduits 32. The water conduits 32 may route the water to air handlers 34 at individual floors or sections of the building 28. The air handlers 34 may also be coupled to ductwork 36 adapted to blow air from an outside intake 38.

The chiller 30, which may include heat exchangers for both evaporating and condensing a refrigerant as described above, may cool water (e.g., refrigerant) that is circulated to the air handlers 34. Air blown over additional coils that receive the water in the air handlers 34 may cause the water to increase in temperature and the circulated air to decrease in temperature. The cooled air is then routed to various locations in the building 28 via additional ductwork. Ultimately, distribution of the air is routed to diffusers that deliver the cooled air to offices, apartments, hallways, and any other interior spaces within the building 28. In many applications, thermostats or other command devices (not shown in FIG. 3) will serve to control the flow of air through and from the individual air handlers 34 and ductwork 36 to maintain desired temperatures at various locations in the structure.

Figure 4:
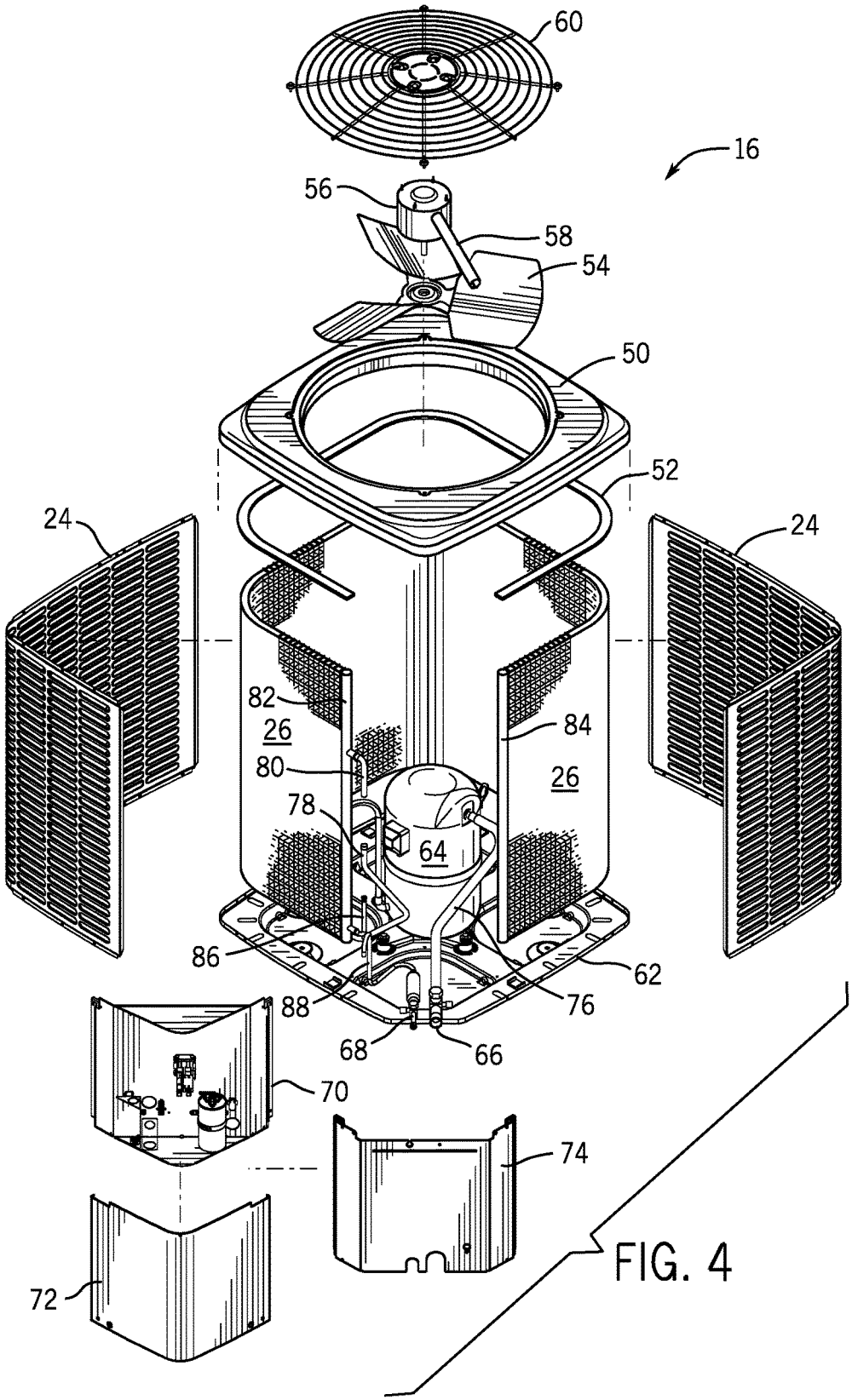
FIG. 4 is another exploded view of the outdoor unit of FIGS. 1 and 2, in accordance with an aspect of the present disclosure.

FIG. 4 illustrates another partially exploded view of the outdoor unit 16. As shown in the illustrated embodiment, the shroud 24 may have two or more pieces configured to surround the sides of the unit 16 and to protect system components from dirt, rain, leaves, and/or other contaminants. The outdoor coil 26 may be positioned adjacent to the shroud 24 and a cover 50 may enclose a top portion of the outdoor coil 26. Foam 52 may be disposed between the cover 50 and the outdoor coil 26 to block air flow in a void between the cover 50 and the outdoor coil 26. A fan 54 may be located within an opening of the cover 50 and be powered by a motor 56. Additionally, a wire way 58 may be used to connect the motor 56 to a power source to operate the fan 54. A fan guard 60 may be disposed within the cover 50 and above the fan 54 to prevent objects (e.g., contaminants) from entering and/or contacting the fan 54.

In certain embodiments, the outdoor coil 26 may be mounted on a base pan 62. The base pan 62 may provide a mounting surface and structure for the internal components of the unit 16. A compressor 64 may be disposed within the center of the unit 16 and be connected to another unit within the HVAC&R system, for example the indoor unit 14, by connections 66 and 68. The connections 66 and 68 may be configured to connect the unit 16 to conduits circulating refrigerant within the HVAC&R system. Additionally, a control box 70 may house control circuitry for the outdoor unit 16 and be protected by a cover 72. In certain embodiments, a multi-bracket coil mount (e.g., a bracket coupling the outdoor coil to the shroud 24) may be utilized to mount the control box 70 to the unit 16. In other embodiments, a panel 74 may be used to mount the control box 70 to the unit 16.

Vaporous refrigerant may enter the unit 16 through the connection 66 and flow through a conduit 76 into the compressor 64. In certain embodiments, the vaporous refrigerant may be received from the indoor unit 14 (not shown). After undergoing compression in the compressor 64, the refrigerant may exit the compressor 64 through a conduit 78 and enter the outdoor coil 26 through inlet 80. The inlet 80 may direct the refrigerant into a first header 82 (e.g., a first manifold). From the first header 82, the refrigerant may flow through the outdoor coil 26 to a second header 84 (e.g., a second manifold). From the second header 84, the refrigerant may flow back through the outdoor coil 26 and exit through an outlet 86 disposed on the first header 82. After exiting the outdoor coil 26, the refrigerant may flow through conduit 88 to connection 68 to return to the indoor unit 14, for example, where the process may begin again. It should be noted, that while the illustrated embodiment of FIG. 4 shows the inlet 80 and the outlet 86 located on the first header 82, the inlet 80 and/or the outlet 86 may be positioned on the second header 84.

As discussed above, variations in geometry and/or shape of the outdoor coil 26 may occur during formation of the outdoor coil 26. For example, the relative position of ends (e.g., the first header 82 and the second header 84) of the coil 26 may vary as a result of manufacturing imperfections (e.g., engineering tolerances). Accordingly, it may be desirable to secure the outdoor coil 26 to the base pan 62 using a bracket having a pliable material (e.g., plastic) to enable a flexible connection that accounts for variations in geometry of the outdoor coil 26. For example, a plastic bracket may enable a more flexible connection between the outdoor coil 26 and the base pan 62 because of the pliability of plastic. Additionally, the shroud 24 is typically coupled to the outdoor unit 16, and in some cases to the outdoor coil 26. However, it may be undesirable to couple the shroud to a plastic bracket securing the outdoor coil 26 to the base pan 62 because screws and/other other fasteners may cause cracks and/or other damage to the plastic bracket. Accordingly, a bracket that includes a more rigid material (e.g., metal) may be desired to couple the shroud 24 to the outdoor unit 16. It is now recognized that a multi-bracket coil mount (e.g., a coil mount that includes an integrated flexible bracket and a rigid bracket) may be desirable to flexibly secure the outdoor coil 26 to the base pan 62 while enabling a secure connection between the shroud 24 and the outdoor unit 16.

For example, FIG. 5 illustrates an exploded view of the first header 82 of the outdoor coil 26 having a multi-bracket coil mount 100. For example, the multi-bracket coil mount 100 includes a flexible bracket 102 (e.g., plastic bracket, first bracket) and a rigid bracket 104 (e.g., a metal bracket, second bracket). The first header 82 of the outdoor coil 26 may include the inlet 80 and the outlet 86 that enable refrigerant to flow to and from the outdoor coil 26. Accordingly, the flexible bracket 102 may include a first opening 106 configured to receive the inlet 80 and a second opening 108 configured to receive the outlet 86. In other embodiments, the flexible bracket 102 may include a single opening configured to receive both the inlet 80 and the outlet 86. In any case, the flexible bracket 102 may be coupled to the first header 82 without obstruction from the inlet 80 and the outlet 86 via the openings 106 and/or 108. In certain embodiments, the flexible bracket 102 may be configured as a friction fit, such that the flexible bracket 102 may be coupled to the first header 82 without additional fasteners (e.g., screws, bolts, rivets). For example, the flexible bracket 102 may include a primary recess 110 that may include a cross-sectional shape substantially or generally similar to a cross-sectional shape of the first header 82 so that the flexible bracket 102 may receive and secure the first header 82 in the primary recess 110. In other embodiments, the flexible bracket 102 may be coupled to the first header 82 using additional fasteners, such as mechanical fasteners (e.g., screws, bolts, rivets), and/or an adhesive (e.g., glue, epoxy, or tape).

The flexible bracket 102 may include any material that may enable a flexible connection between the base pan 62 and/or other component of the outdoor unit 16 and the outdoor coil 26. For example, the flexible bracket 102 may be secured into the base pan 62 via an interference fit (e.g., the base pan 62 may include grooves and/or protrusions disposed on a mounting surface of the base pan 62 configured to receive corresponding fastening members of the flexible bracket 102). In other embodiments, the flexible bracket 102 may be integrated with the base pan 62 (e.g., the flexible bracket 102 and the base pan 62 are formed as a single, plastic mold). To accommodate variations in the geometry and/or shape of the outdoor coil 26, it may be desirable that the flexible bracket 102 include a pliable material. For example, the flexible bracket 102 may include plastic, rubber, latex, or any combination thereof.

In certain embodiments, the flexible bracket 102 may include one or more features that may enable the flexible bracket 102 to be coupled to the rigid bracket 104 without utilizing a fastener (e.g., a screw or a bolt). Accordingly, the rigid bracket 104 may be secured to the flexible bracket 102 without creating (e.g., drilling) holes in the flexible bracket 102 that may cause cracking and/or other damage to the flexible bracket 102. For example, the flexible bracket 102 may include a plurality of fastening tabs 112 configured to receive a protruding ridge 114 of the rigid bracket 104. For example, the illustrated embodiment of FIG. 5 shows the protruding ridge 114 having a length 116 that corresponds to the fastening tabs 112 of the flexible bracket 102. In certain embodiments, the fastening tabs 112 may be configured to interlock with the protruding ridge 114 to secure the protruding ridge 114 of the rigid bracket 104 to the flexible bracket 102. Further, the protruding ridge 114 may be received by the fastening tabs 112 in an alternating manner such that a first fastening tab contacts a first surface of the protruding ridge 114, a second fastening tab, adjacent to the first fastening tab, contacts a second surface of the protruding ridge 114, a third fastening tab, adjacent to the second fastening tab, contacts the first surface of the protruding ridge 114, and so forth. Accordingly, the rigid bracket 104 may be secured to the flexible bracket 102 such that a connection between the rigid bracket 104 and the shroud 24 indirectly couples the shroud 24 to the flexible bracket 102, and thus, the outdoor coil 26.

Similarly, FIG. 6 illustrates an exploded view of the second header 84 of the outdoor coil 26 having the multi-bracket coil mount 100. In certain embodiments, although the second header 84 may not include the inlet 80 and the outlet 86, the flexible bracket 102 may still include the openings 106 and 108 such that a single flexible bracket mold may be manufactured. In other words, two self-similar brackets may be used for the two flexible brackets 102 in FIGS. 5 and 6. Additionally, the flexible bracket 102 shown in FIG. 6 is rotated approximately 90 degrees from the embodiment shown in FIG. 5. Accordingly, the illustrated embodiment of FIG. 6 shows the flexible bracket 102 having a first recessed member 120 and a second recessed member 122. The first and second recessed members 120, 122 may be configured to receive a first protruding member 124 and a second protruding member 126 of the rigid bracket 104, respectively. In certain embodiments, the first protruding member 124 may include a length 128 that is greater than a length 130 of the second protruding member 126. Such a difference in lengths 128, 130 may facilitate assembly of the heat exchanger. For example, the entire length 128 of the first protruding member 124 may be inserted into the first recessed member 120 by sliding the first protruding member in a direction 132. An end 134 of the second protruding member 126 may then be positioned above the second recessed member 122. Accordingly, the rigid bracket 104 may be translated in a direction 136 such that the first and second protruding members 124, 126 are secured in the first and second recessed members 120, 122, respectively.

As described above with respect to FIGS. 5 and 6, the flexible bracket 102 may be utilized to couple both the first and second headers 82, 84 to the base plate 62 and/or another component of the heat exchanger. Therefore, a single mold (e.g., a plastic mold) may be utilized to manufacture the flexible bracket 102. FIG. 7 illustrates a perspective view of the flexible bracket 102. As discussed above, the flexible bracket 102 may also be utilized to indirectly couple the shroud 24 to the outdoor coil 16, via a connection with the rigid bracket 104. The illustrated embodiment of FIG. 7 shows the fastening tabs 112 as well as the recessed members 120 and 122 for securing the rigid bracket 104 to the flexible bracket 102. Additionally, the flexible bracket 102 may include the primary recess 110 having a cross-section that includes a rounded portion 140, which may include a partially circular shape. Additionally, the flexible bracket 102 may include a first flange 142. The first flange 142 may be substantially or generally flat such that the first flange 142 may be positioned proximate to a first surface of the outdoor coil 16 and provide a stable connection between the flexible bracket 102 and the outdoor coil 16. In certain embodiments, the flexible bracket 102 may also include a second flange 144, which may be substantially or generally parallel to the first flange 142, but positioned a distance 146 (e.g., corresponding to a thickness of the outdoor coil 26) apart from the first flange 142. The second flange 144 may be positioned proximate to a second surface of the outdoor coil 16 and be configured to provide a stable connection between the flexible bracket 102 and the outdoor coil 16. A cross-sectional view of the flexible bracket is provided in FIG. 8.

FIG. 8 illustrates a cross-sectional, axial view of the flexible bracket 102. As shown in the illustrated embodiment, the flexible bracket 102 includes the primary recess 110. In certain embodiments, the primary recess 110 may include the rounded portion 140, which may include a partially circular shape. In other embodiments, the primary recess 110 may include any suitable shape configured to receive and mate with the first header 82 and/or the second header 84. Accordingly, the primary recess 110 may include a cross-sectional shape substantially or generally similar to a cross-sectional shape of the first and/or second headers 82, 84.

Additionally, FIG. 8 shows the flexible bracket 102 having the first flange 142 and the second flange 144. In certain embodiments, the first flange 142 may include a width 150 and the second flange 144 may include a width 152, which may be smaller than the width 150. For example, the width 150 may be larger than the width 152 to facilitate attachment and removal of the flexible bracket 102 to the outdoor coil 26 (e.g., the flexible bracket 102 may rotate more easily on and off of the outdoor coil 26 by applying a radial force toward the second flange 144). Additionally, the first and second flanges 142, 144 may be substantially or generally parallel and positioned the distance 146 from one another. In certain embodiments, the distance 146 may correspond to a width of the outdoor coil 26. For example, the first and second flanges 142, 144 of the flexible bracket 102 may be configured to contact or be positioned proximate to the first and second surfaces of the outdoor coil 26 such that the flexible bracket 102 is secured to the outdoor coil 26.

The flexible bracket 102 may also include a hook 154, which may be configured to secure one or more wires to the flexible bracket 102. As discussed above, one or more wires may be utilized to establish an electrical connection between components in the heat exchanger. For example, one or more wires may be utilized to couple the motor 56 to the fan 54, such that the motor 56 may supply power to and operate the fan 54. The hook 154 securing the one or more wires will be discussed in more detail herein with reference to FIG. 24.

The cross-section of the flexible bracket 102 shown in FIG. 8 also illustrates the fastening tabs 112 and the recessed member 120. In certain embodiments, the fastening tabs 112 may be utilized as friction fit devices that are configured to receive and secure the protruding ridge 114 of the rigid bracket 104 without additional fasteners (e.g., screws, bolts, rivets). For example, the fastening tabs 112 may include one or more "J" shaped protrusions. In other embodiments, the fastening tabs 112 may be any suitable shape configured to receive and secure the protruding ridge 114 and/or the protruding members 124, 126 of the rigid bracket 104. As shown in the illustrated embodiment of FIG. 8, the recessed member 120 may include an opening 156 having an oval-shaped cross-section. In other embodiments, the opening may be rectangular, circular, square, or any other suitable shape configured to receive the protruding ridge 114 and/or the protruding members 124, 126 of the rigid bracket 104.

FIG. 8 also illustrates that the flexible bracket 102 may include a stabilizing member 158. For example, the stabilizing member 158 may be utilized to enhance or improve the connection between the flexible bracket 102 and the rigid bracket 104. For example, the rigid bracket 104 may include a length that is greater than the width 152 of the second flange 144. Additionally, the rigid bracket 104 may not be a substantially or generally flat piece (e.g., the rigid bracket may be substantially or generally corrugated). In certain embodiments, the rigid bracket 104 may include a contoured surface, one or more recesses, and/or one or more protrusions. Therefore, the stabilizing member 158 may account for the length and/or the uneven surface of the rigid bracket to provide additional support to the rigid bracket 104. In some embodiments, the stabilizing member 158 may have a "Z" shape, or a staircase shape, configured to stabilize the rigid bracket 104 when the protruding member 114 (e.g., a protruding ridge) is disposed in the fastening tabs 112.

The rigid bracket 104 may couple to the flexible bracket 106 via the recessed members 120, 122 and/or the fastening tabs 112. Accordingly, the rigid bracket 104 may have features (e.g., the protruding ridge 114 and/or the protruding members 124, 126) that correspond to each of the securement features (e.g., the recessed members 120, 122 and/or the fastening tabs 112) of the flexible bracket 102. FIG. 9 illustrates a cross-sectional view of a first end 169 of the rigid bracket 104. As shown in the illustrated embodiment of FIG. 9, the rigid bracket 104 has a base 170, a contoured surface 172, the protruding ridge 114, and the first protruding member 124.

In certain embodiments, the rigid bracket 104 may be formed from (e.g., manipulated from) a substantially or generally flat sheet of a rigid material (e.g., metal, ceramic, hard plastic). The base 170 may therefore include portions of the flat sheet that were not manipulated during formation of the rigid bracket 104. Accordingly, the contoured surface 172 may be a trapezoid-shaped recess formed in the base 170. In certain embodiments, the contoured surface 172 may include a first arm 174 and a second arm 176. The first and second arms 174, 176 may be connected by a support member 178. It should be noted that in other embodiments the contoured surface may be substantially or generally round (e.g., a partially circular shape) or include another suitable shape. The contoured surface 172 may be formed in the rigid bracket 104 to close a gap between the rigid bracket 104 and the shroud 24. For example, when the rigid bracket 104 is secured to the flexible bracket 102, a gap may exist between the rigid bracket 104 and the shroud 24, thereby making a connection between the rigid bracket 104 and the shroud 24 difficult to establish (e.g., it may be difficult to fasten components together when a substantial gap exists between them). Moreover, coupling the rigid bracket 104 to the shroud 24 when the gap exists may create undesirable stress on the flexible bracket 102 as the gap is closed (e.g., as the rigid bracket 104 is secured to the flexible bracket 102, the flexible bracket 102 may move with the rigid bracket 104). Therefore, the contoured surface 172 may be formed, or may protrude, toward the shroud 24 to facilitate a connection between the rigid bracket 104 and the shroud 24 by narrowing the gap. The connection between the contoured surface 172 and the shroud 24 is described in more detail herein with reference to FIG. 20.

The protruding ridge 114 may be formed from the base 170. For example, an edge of the base 170 may be bent into an "L" shape to form the protruding ridge 114. In certain embodiments, the protruding ridge 114 may span an entire length of the base 170. In other embodiments, the protruding ridge 114 may span a portion of the length of the base 170.

The rigid bracket 104 illustrated in FIG. 9 also shows the first protruding member 124. In certain embodiments, the first protruding member 124 may be formed from the base 170. For example, a portion of the base 170 may be cut and separated from the base 170 to form the first protruding member 124. The portion of the base 170 may then be manipulated (e.g., bent or otherwise shaped) to create the first protruding member 124, which may be offset a distance 180 from the base 170. In other embodiments, however, the first protruding member 124 may be a separate component that is later coupled to the rigid bracket 104 (e.g., welded, glued, or otherwise fastened). As discussed above, the first protruding member 124 may be configured to fit within the first and/or second recessed members 120, 122 of the flexible bracket 102. In this manner, the flexible bracket 102 and the rigid bracket 104 may be secured together without the use of an additional fastener (e.g., a screw, a bolt, a rivet).

Additionally, although not shown in the illustrated embodiment of FIG. 9, the rigid bracket 104 may include the second protruding member 126 on a second end of the rigid bracket 104, where the second end is opposite the first end 169. The second protruding member 126 may also be formed from the base 170. For example, a second portion of the base 170 may be cut and separated from the base 170 to form the second protruding member 126. The second portion of the base 170 may then be manipulated (e.g., bent or otherwise shaped) to create the second protruding member 126, which may be offset a distance (e.g., the distance 180) from the base 170. In other embodiments, however, the second protruding member 126 may be a separate component that is later coupled to the rigid bracket 104 (e.g., welded, glued, or otherwise fastened). As discussed above, the second protruding member 126 may also be configured to fit within the first and/or second recessed members 120, 122 of the flexible bracket 102. In this manner, the flexible bracket 102 and the rigid bracket 104 may be secured together without the use of an additional fastener (e.g., a screw, a bolt, a rivet).

As discussed above, the rigid bracket 104 may be formed from a single sheet of a rigid material (e.g., metal). For example, FIG. 10 illustrates a top view of the rigid bracket 104 formed from a single sheet of a rigid material (e.g., metal). As shown in the illustrated embodiments, the length 116 of the protruding ridge 114 is substantially or generally equal to a length of the base 170. Conversely, forming the first protruding member 124, as well as the second protruding member 126, in the single sheet of the rigid material (e.g., metal) may shorten a length of the rigid bracket 104 where the first and second protruding members 124, 126 are positioned. For example, in the illustrated embodiment of FIG. 10, the first protruding member 124 is positioned on the first end 169 of a first edge 188 of the rigid bracket 104. Similarly, the second protruding member 126 is positioned on the second end 189 of the first edge 188 of the rigid bracket 104. Therefore, the first edge 188 of the rigid bracket 104 may include a length 192 that is less than a length 194 of the base 170, the contoured surface 172, the protruding ridge 114, and/or a second edge 196 (e.g., the edge forming the protruding ridge 114). The shortened length 192 of the first edge 188 results from forming the first and second protruding members 124, 126 from the same material as the remaining rigid bracket 104. In other embodiments, the first and second protruding members 124, 126 may be formed from a separate material, thereby enabling the length 192 of the first edge 188 to be substantially or generally equal to the length 194 of the base 170, the contoured surface 172, the protruding ridge 114, and/or the second edge 196.

Additionally, the illustrated embodiment of FIG. 10 shows the rigid bracket 104 including a plurality of holes 198 (e.g., openings). The holes 198 may be utilized to couple the rigid bracket 104 to the shroud 24 using a plurality of fasteners (e.g., screws, bolts, rivets, or other coupling devices). However, the fasteners utilized to couple the rigid bracket 104 to the shroud 24 may not contact the flexible bracket 102 to avoid creating cracks and/or other modifications to the flexible bracket 102. Accordingly, the rigid bracket 104 and the flexible bracket 102 may be configured to couple to one another without the use of fasteners such as nails, screws, bolts, rivets, or the like.

As discussed above, the outdoor coil 26 may include the first header 82 and the second header 84. In certain embodiments, a connection between the flexible bracket 102 and the rigid bracket 104 may be different depending on which header, 82 or 84, the flexible bracket 102 is mounted on. For example, FIGS. 11-15 illustrate the connection between the flexible bracket 102 and the rigid bracket 104 when the flexible bracket 102 is mounted on the first header 82 (e.g., the header 82 having the inlet 80 and/or the outlet 86). Additionally, FIGS. 16-19 illustrate the connection between the flexible bracket 102 and the rigid bracket 104 when the flexible bracket 102 is mounted on the second header 84 (e.g., the header 82 without the inlet 80 and/or the outlet 86).

FIG. 11 is a perspective view of the flexible bracket 102 coupled to the first header 82 of the outdoor coil 26 as well as the rigid bracket 104 secured to the flexible bracket 102. As shown in the illustrated embodiment of FIG. 11, the rigid bracket 104 is secured to the flexible bracket 102 such that the flexible bracket 102 and the rigid bracket 104 are an integrated bracket assembly (e.g., the multi-bracket coil mount 100). For example, the protruding ridge 114 of the rigid bracket 104 is disposed within the fastening tabs 112 of the flexible bracket 102. As shown in the illustrated embodiment, the fastening tabs 112 interlock with the protruding ridge 114, and thus the rigid bracket 104. Interlocking between the fastening tabs 112 and the protruding ridge 114 may occur as the fastening tabs 112 alternate contacting a first surface of the protruding ridge 114 and a second surface of the protruding ridge 114. Accordingly, the rigid bracket 104 may be secured to the flexible bracket 102. Therefore, when the rigid bracket 104 is coupled to the shroud 24 (e.g., via a plurality of screws, bolts, or rivets), the shroud 24 is indirectly coupled to the outdoor coil 26 via the flexible bracket 102 coupled to the first header 82.

In certain embodiments, the flexible bracket 102 may be coupled to the first header 82 via the primary recess 110. The primary recess 110 may be a friction fit configured to receive the first header 82 and secure the flexible bracket 102 to the first header 82. Additionally, the flexible bracket 102 may be coupled to the base pan 62 and the outdoor coil 26 may be secured to the base pan 62 via the first header 82 and the flexible bracket 102. In certain embodiments, the flexible bracket 102 and the base pan 62 may be molded into a single, integrated component. In other embodiments, the flexible bracket 102 may be coupled to the base pan 62 via an adhesive (e.g., glue, epoxy, or tape) or a fastener (e.g., a screw, a bolt, a rivet).

FIG. 12 illustrates a close-up perspective view of a connection between the protruding ridge 114 of the rigid bracket 104 and a first set 210 of fastening tabs 112 located on a first end 212 of the flexible bracket 102. The illustrated embodiment of FIG. 12 also shows the first opening 106 configured to receive the inlet 80. Therefore, the flexible bracket 102 may couple to the first header 82 without any obstruction from the inlet 80, because the inlet 80 may simply extend outward from the first header 82 and through the first opening 106.

FIG. 13 illustrates a close-up perspective view of a connection between the protruding ridge 114 of the rigid bracket 104 and a second set 230 of fastening tabs 112 located on a middle portion 232 of the flexible bracket 102. The second set 230 of the fastening tabs 112 may be located approximately in a middle of the length 116 of the protruding ridge 114. Accordingly, the second set 230 of fastening tabs 112 may further secure the protruding ridge 114 and, thus, enhance and improve the connection between the rigid bracket 104 and the flexible bracket 102.

FIG. 14 illustrates a close-up perspective view of a connection between the protruding ridge 114 of the rigid bracket 104 and a third set 240 of fastening tabs 112 located on a second end 242 of the flexible bracket 102. The illustrated embodiment of FIG. 14 also shows the second opening 108 configured to receive the outlet 86. Therefore, the flexible bracket 102 may couple to the first header 82 without any obstruction from the outlet 86, because the outlet 86 may simply extend outward from the first header 82 and through the second opening 108.

FIG. 15 illustrates a cross-sectional axial view of the multi-bracket coil mount 100 coupled to the outdoor coil 26 (e.g., via the first header 82). Additionally, FIG. 15 illustrates a connection between the flexible bracket 102 and the rigid bracket 104. As shown in the illustrated embodiment the protruding ridge 114 is disposed within the "J" shaped fastening tab 112. For example, the protruding ridge 114 may be configured to fit snugly within the fastening tab 112 such that the protruding ridge 114 and the rigid bracket 104 may not incur any substantial, unprompted movement (e.g., movement when no external force is applied to the protruding ridge 114 and/or the rigid bracket 104).

In certain embodiments, the protruding ridge 114 may include a securement member 250 and an extension member 252. For example, the securement member 250 may fit within the fastening tabs 112, whereas the extension member 252 may be clamped between the fastening tabs 112 and the stabilizing member 158. Moreover, the base 170 of the rigid bracket 104 may contact the stabilizing member 158, thereby providing support to the base 170, the contoured surface 172, and/or the first and second protruding members 124, 126 (e.g., the stabilizing member 158 may provide support to the rigid bracket 104 such that the rigid bracket 104 does not incur substantial, unprompted movement). As shown in the illustrated embodiment of FIG. 15, the first protruding member 124 and/or the second protruding member 126 do not contact the flexible bracket 102 (e.g., the first and/or second protruding members 124, 126 are not disposed in or received by the recessed members 120, 122 of the flexible bracket 102 when the flexible bracket 102 is coupled to the first header 82). Accordingly, when the flexible bracket 102 is coupled to the first header 82, the protruding ridge 114 may be configured to interact with the flexible bracket 102 (e.g., via the fastening tabs 112) to secure the rigid bracket 104 to the flexible bracket 102. However, when the flexible bracket 102 is coupled to the second header 84, the first and/or second protruding members 124, 126 may interact with the flexible bracket 102 (e.g., via the recessed members 120 and/or 122) to secure the rigid bracket 104 to the flexible bracket 102, as described below.

For example, FIG. 16 is a perspective view of the flexible bracket 102 coupled to the second header 84 of the outdoor coil 26 and the rigid bracket 104 secured to the flexible bracket 102. As shown in the illustrated embodiment of FIG. 16, the first protruding member 124 is disposed in the first recessed member 120 of the flexible bracket 102. Similarly, the second protruding member 126 is disposed in the second recessed member 122 of the flexible bracket 102. As discussed above, the first protruding member 124 may be inserted into the first recessed member 120 and translated in the direction 132, such that the second protruding member 126 is positioned above an opening of the second recessed member 122. Therefore, the rigid bracket 104 may be translated in the direction 136, which may be generally opposite to the direction 132, and the second protruding member 126 may be inserted into the second recessed member 122. Accordingly, the first protruding member 124 may be secured in the first recessed member 120, and the second protruding member 126 may be secured in the second recessed member 122, such that the rigid bracket 104 is coupled to the flexible bracket 102 (e.g., without any additional screws, bolts, and/or rivets). Additionally, as shown in the illustrated embodiment of FIG. 16, the protruding ridge 114 does not contact the flexible bracket 102 (e.g., interact with or couple to a component of the flexible bracket 102) when the flexible bracket 102 is coupled to the second header 84.

FIG. 17 illustrates a close-up perspective view of a connection between the first protruding member 124 of the rigid bracket 104 and the first recessed member 120 of the flexible bracket 102. In certain embodiments, when the rigid bracket 104 is secured to the flexible bracket 104 a portion 260 of the first protruding member 124 may extend from the first recessed member 120 (e.g., the portion 260 is not disposed in, or received by, the first recessed member 120). The portion 260 may be included to facilitate coupling of the rigid bracket 104 to the flexible bracket 102. For example, the first protruding member 124 may be disposed in the first recessed member 120 and translated in the direction 132. In certain embodiments, the portion 260 of the first protruding member 124 may be inserted into the first recessed member 120 such that an end of the first protruding member 124 extends beyond a top opening 262 of the first recessed member 120. In such embodiments, the second protruding member 126 may then be positioned above an opening (not shown) of the second recessed member 122. The rigid bracket 104 may then be translated in the direction 136 such that the second protruding member 126 is inserted into the opening of the second recessed member 122.

For example, FIG. 18 illustrates a close-up perspective view of a connection between the second protruding member 126 of the rigid bracket 104 and the second recessed member 122 of the flexible bracket 102. In certain embodiments, the entire second protruding member 126 may be disposed in the opening 270 of the second recessed member 122. In other embodiments, only a portion of the second protruding member 126 may be inserted into the opening 270. In any case, both the first and second protruding members 124, 126 may be at least partially disposed in the first and second recessed members 120, 122, respectively, to secure the rigid bracket 104 to the flexible bracket 102 when the flexible bracket is coupled to the second header 84.

FIG. 19 illustrates a cross-sectional axial view of the multi-bracket coil mount 100 coupled to the outdoor coil 26 (e.g., via the second header 84). Additionally, FIG. 19 illustrates a connection between the first recessed member 120 of the flexible bracket 102 and the first protruding member 124 of the rigid bracket 104. As shown in the illustrated embodiment of FIG. 19, the first recessed member 120 (and the second recessed member 122) has a cross-section in a generally oval or cylindrical shape. In other embodiments, the first recessed member 120 and/or the second recessed member 122 may have a rectangular, square, circular, or any other suitably shaped cross-section that is configured to receive the first protruding member 124 and/or the second protruding member 126.

Additionally, when the first protruding member 124 is disposed in the first recessed member 120 and/or the second protruding member 126 is disposed in the second recessed member 122, a gap 280 may be formed between the base 170 of the rigid bracket 104 and the first recessed member 120 and/or the second recessed member 122 of the flexible bracket. The gap 280 may enable the first and/or second protruding members 124, 126 to be inserted into the first and/or second recessed members 120, 122, without the protruding ridge 114 creating an obstruction (e.g., the protruding ridge 114 blocking insertion of the protruding members 124, 126 into the recessed members 120, 122 via contact with the first flange 142).

As discussed above, the contoured surface 172 may facilitate attachment of the shroud 24 to the rigid bracket 104. In certain embodiments, the contoured surface 172 may close a gap between the shroud 24 and the rigid bracket 104. For example, FIG. 20 illustrates a cross sectional axial view of multi-bracket coil mount 100 coupled to the shroud 24. Specifically, the rigid bracket 104 is coupled to the shroud 24 via one or more fasteners 290. The fasteners 290 may include screws, nuts, nails, rivets, or any other device configured to couple the rigid bracket 104 to the shroud 24. In certain embodiments, the fasteners 290 are inserted through the plurality of holes 198 in the rigid bracket 104, but do not contact or extend through the flexible bracket 102. As discussed previously, the flexible bracket 102 may include a pliable material, which may crack and/or otherwise be modified by the fasteners 290. Accordingly, the rigid bracket 104 may be secured to the flexible bracket 102 as described above without the use of the fasteners, but the flexible bracket 102 may still be indirectly coupled to the shroud 24 via the rigid bracket 104.

As shown in the illustrated embodiment of FIG. 20, the fasteners 290 may extend through the contoured surface 172 as well as the base 170 of the rigid bracket 104. The fasteners 290 that extend through the contoured surface 172 may eliminate any gap between the contoured surface 172 and the shroud 24. Conversely, in certain embodiments, the fasteners 290 extending through the base 170 of the rigid bracket 104 may not eliminate a gap 292 between the base 170 and the shroud 24. In other embodiments, the fasteners 290 may extend through contoured surface 172, but not the base 170 of the rigid bracket 104. The fasteners 290 may be inserted in every hole 198 of the rigid bracket 104, or only certain holes of the rigid bracket 104. In any case, a suitable number of fasteners 290 may be utilized to ensure a secure connection between the rigid bracket 104 and the shroud 24. Therefore, the shroud 24 may be indirectly coupled to the outdoor coil 26 via the connection between the flexible bracket 102 and the rigid bracket 104.

Although discussion thus far has focused on connections between the flexible bracket 102 and the rigid bracket 104 being made between the protruding members 124, 126 and/or the protruding ridge 114 of the rigid bracket 104 and the recessed members 120, 122 and/or the fastening tabs 112 of the flexible bracket 102, it should be recognized that other coupling devices may be employed. For example, FIGS. 21 and 22 illustrate another multi-bracket coil mount 300 that includes a second flexible bracket 302 and a second rigid bracket 304. For example, FIG. 21 illustrates a cross sectional axial view of the multi-bracket coil mount 300 coupled to the first header 82 (e.g., the header 82 that includes the inlet 80 and the outlet 86). In the illustrated embodiment, the second flexible bracket 302 may include a notch 306 configured to receive one or more raised openings or protrusions 308 of the second rigid bracket 304. For example, the second rigid bracket 304 may include a plurality of raised openings 308 that may be configured to receive tubes from a copper tube plate fin, for example. The notch 306 of the second flexible bracket 302 may include a cross-section having a shape configured to receive the raised openings 308, and thus, clamp, receive, and secure the second rigid bracket 304 to the second flexible bracket 302.

The second rigid bracket 304 may include the contoured surface 172 to close a gap that may form between the second rigid bracket 304 and the shroud 24. However, in the illustrated embodiment of FIG. 21, the second rigid bracket 304 does not include the protruding ridge 114 or the first and second protruding members 124, 126. Rather, the second rigid bracket 304 is secured in the notch 306 via the raised openings 308.

Additionally, the embodiment shown in FIG. 21 illustrates the second flexible bracket 302 having an "H" shaped member 310 on a side 312 of the outdoor coil 26 opposite a side 314 adjacent to the notch 306 of the flexible bracket 302. The "H" shaped member 310 may be configured to receive another component of the outdoor unit 16. For example, the "H" shaped member may receive a substantially or generally flat portion 316 of the second rigid bracket 304 when the second flexible bracket 302 is coupled to the second header 84.

Similarly, FIG. 22 is a perspective view of the second rigid bracket 304. As shown in the illustrated embodiment of FIG. 22, the second rigid bracket 304 includes the holes 198 that may be configured to receive the fasteners 290 that may couple the second rigid bracket 304 to the shroud 24. Additionally, FIG. 22 shows the raised openings 308 spaced a distance 318 apart from one another. The distance 318 may correspond to a distance between tubes of a copper tube plate fin, for example.

In some embodiments (e.g., embodiments that include a copper tube plate fin instead of a microchannel coil), the openings 308 may receive portions (e.g., end portions) of the copper tube plate fin. In such embodiments, the second flexible bracket 302 may not be included, such that the openings 308 directly couple the second rigid bracket 304 to the shroud 24 (e.g., the copper tube plate fin). For example, FIG. 23 is a perspective view of an embodiment of the second rigid bracket 304 that includes a first portion 320 that is substantially perpendicular to a second portion 322 of the second rigid bracket 304. As shown in the illustrated embodiment of FIG. 23, the first portion 320 and the second portion 322 form an angle 324 (e.g., between 80 and 100 degrees). The first portion 320 (e.g., a portion that includes the openings 308) may receive the copper tube plate fin (e.g., ends of the copper tube plate fin) and the second portion 322 may extend parallel to a face of the shroud 24 (e.g., the copper tube plate fin). Accordingly, the second flexible bracket 302 may not be included in such embodiments where the first portion 320 is substantially perpendicular to the second portion 322 because the first portion 320 of the second rigid bracket 304 may be directly coupled to the shroud 24 (e.g., the copper tube plate fin).

The flexible bracket 102, 302 may couple the outdoor coil 26 to the base plate 62 or another component of the outdoor unit 16 to substantially or generally secure the outdoor coil 26 in one place. However, the flexible bracket 102, 302 may also include additional features that may facilitate assembly and/or maintenance of the outdoor unit 16. For example, FIG. 24 shows a perspective view of the flexible bracket 102 having the hook 154 and a coupling member 330 configured to guide a wire 332 from an opening 334 (e.g., the wire way 58) in the cover 50 toward a desired component and/or device. For example, the wire 332 is around the hook 154 such that the wire is blocked from moving in a direction 336 (e.g., a radial direction). Additionally, the wire 332 may be adjacent to a surface 338 of the coupling member 330. In certain embodiments, the surface 338 may face a direction 340 opposite the direction 336, such that the coupling member 330 may also block movement of the wire 332 in the direction 336. In certain embodiments, the coupling member 330 may include an opening 342 to receive a fastener 344 (e.g., a zip tie) configured to tighten the wire 332 against the surface 338. In other words, the fastener 344 may enable the wire 332 to remain substantially or generally stationary with respect to the flexible bracket 102. It is now recognized that keeping the wire 332 substantially or generally stationary with respect to the flexible bracket 102 may block the wire 332 from contacting movable components of the outdoor unit 16 that may cause the wire 332 to disconnect or otherwise move unintentionally. Additionally, blocking or reducing movement of the wire 332 may facilitate maintenance of the outdoor unit 16 by keeping the wire 332 from interfering with the work of a maintenance person, for example.

Just as the flexible bracket 102 may provide additional benefits beyond coupling the outdoor coil 26 to the base pan 62, the rigid bracket 104 (and/or the second rigid bracket 304) may also include features that may be desirable beyond coupling the outdoor coil 26 to the shroud 24. For example, when the outdoor unit 16 includes the control box 70, the rigid bracket 104 (and/or the second rigid bracket 304) may be configured to receive and hold the control box 70 in place. Moreover, the rigid bracket 104 and/or 304 and the control box 70 may include features that enable the control box 70 to swing out from the outdoor coil 26 to facilitate and enable maintenance. For example, FIG. 25 is a side view of a first wall 350 of the control box 70 having braces 352 or other retaining features that may be configured to lock the control box 70 into the rigid bracket 104 and/or 304. In certain embodiments, the braces 352 may be substantially or generally triangular in shape such that the braces 352 may not be removed from slots in the rigid bracket 104 and/or 304 without manipulation by a maintenance person, for example. In other embodiments, the braces 352 may include any suitable shape to keep the first wall 350 of the control box 70 coupled to the rigid bracket 104 and/or 304.

FIG. 26 illustrates a perspective view of the braces 352 of the control box 70 inserted into slots 354 of the rigid bracket 104 and/or 304 configured to receive the braces 352 of the control box 70. The illustrated embodiment of FIG. 26 shows the rigid bracket 104 and/or 304 coupled to the flexible bracket 102 on the second header 84. Accordingly, it may be desired to keep the first wall 350 of the control box 70 coupled to the rigid bracket 104 and/or 304 at the second header 84. In other words, when the braces 352 of the control box 70 are inserted into the slots 354 of the rigid bracket 104 and/or 304, the first wall 350 of the control box 70 may remain coupled to the rigid bracket 104 and/or 304 absent manipulation by the maintenance person.

Conversely, FIG. 27 illustrates a second wall 356 of the control box 70 having tabs 358. In certain embodiments, the tabs 358 may be substantially or generally rectangular-shaped, or square-shaped, and have a length 360 that is substantially less than a length of the braces 352. Accordingly, the tabs 358 may not be configured to maintain a connection between the second wall 356 and the rigid bracket 104 and/or 304. Rather, the tabs 358 may be inserted into the slots 354 of the rigid bracket 104 and/or 304, but the tabs 358 may be configured to be easily removed from the slots 354 without substantial manipulation by the maintenance person (e.g., the maintenance person may pull on the second wall 356 and the tabs 358 may be removed).

FIG. 28 is a perspective view of the tabs 358 inserted into the slots 354 of the rigid bracket 104 and/or 304 when the rigid bracket 104 and/or 304 is coupled to the flexible bracket 102 and the flexible bracket is coupled to the first header 82. Accordingly, the maintenance person may pull on the second wall 356 causing the control box 70 to rotate about the second header 84 (e.g., the connection between the braces 352 and the rigid bracket 104 and/or 304 remains intact).

For example, FIG. 29 illustrates a perspective view of the outdoor unit 16 when the control box 70 has been rotated about the second header 84 (e.g., the tabs 358 are not disposed in the slots 354 of the rigid bracket 104 and/or 304). As shown in the illustrated embodiment, when the control box 70 is rotated about the second header 84 an opening 362 may be formed enabling access to the inside of the outdoor coil 26. Therefore, the braces 352, the slots 354, and the tabs 358 may facilitate maintenance of the outdoor unit 16 by providing relatively easy access to the maintenance person.

FIG. 30 illustrates a perspective view of the control box 70 having a rain guard 270. The rain guard 270 may protect wires (not shown) by blocking the wires from any rain or other debris that may enter the outdoor unit 16 through the shroud 24. For example, the rain guard 270 may be substantially or generally dome-shaped. Accordingly, the rain guard 270 may be configured to direct rain (or other contaminants) to flow over a surface 272 of the rain guard 270, and thereby block contact with the wires. Additionally, the rain guard 270 may direct the wires in a desired direction and prevent undesirable movement of the wires.

While only certain features and embodiments of the present disclosure have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described (i.e., those unrelated to the presently contemplated best mode of carrying out an embodiment, or those unrelated to enabling the claimed embodiments). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A bracket system, comprising:

a first bracket configured to couple a heat exchanger coil to a first base of a heat exchanger via engagement of a mounting surface of the first base, wherein the first bracket comprises a recessed member having an opening and a fastening tab; and a second bracket configured to couple the heat exchanger coil to a shroud of the heat exchanger via engagement of a fastener, wherein the second bracket comprises a second base, a protruding member extending from the second base and offset from the second base with respect to an axis defining a length of the second bracket, and a protruding ridge coupled to the second base;

wherein the opening of the recessed member of the first bracket is configured to slidably receive the protruding member of the second bracket such that the first bracket and the second bracket are coupled to one another in a first configuration of the bracket system, and wherein the protruding ridge of the second bracket is configured to engage the fastening tab of the first bracket via a friction fit such that the first bracket and the second bracket are coupled to one another in a second configuration of the bracket system.

2. The bracket system of claim 1, wherein the first bracket is formed from plastic, rubber, latex, or a combination thereof.

3. The bracket system of claim 1, wherein the second bracket is formed from metal.

4. The bracket system of claim 1, comprising the shroud of the heat exchanger, and wherein the shroud is fastened to the second bracket via a screw or other fastener.

5. The bracket system of claim 4, wherein the screw or other fastener does not contact the first bracket.

6. The bracket system of claim 1, wherein the second bracket comprises one or more slots configured to receive one or both of a brace and a tab of a control box to couple the control box to the heat exchanger coil.

7. The bracket system of claim 6, wherein one or both of the brace and the tab of the control box are configured to enable a wall of the control box coupled to the heat exchanger coil to rotate about a header of the heat exchanger coil.

8. The bracket system of claim 6, wherein the control box comprises a rain guard.

9. The bracket system of claim 1, wherein the first bracket comprises a hook configured to secure one or more wires to the first bracket.

10. The bracket system of claim 9, wherein the first bracket comprises a coupling member configured to receive a fastener to secure the one or more wires to the first bracket, and wherein the coupling member is generally aligned with the hook with respect to the first bracket.

11. The bracket system of claim 1, wherein the first bracket comprises a primary recess configured to receive one or both of an inlet and an outlet of the heat exchanger coil.

12. The bracket system of claim 1, wherein the second bracket comprises a plurality of holes configured to facilitate coupling the second bracket to the shroud of the heat exchanger.

13. The bracket system of claim 1, comprising a third bracket and a fourth bracket, wherein the third bracket is configured to be coupled to the heat exchanger coil, the fourth bracket is secured to the third bracket, and the fourth bracket is coupled to the shroud of the heat exchanger.

14. The bracket system of claim 1, comprising the heat exchanger, and wherein the heat exchanger is an outdoor air conditioning unit.

15. A heat exchanger, comprising:

a heat exchanger coil comprising a first header and a second header;

a shroud configured to cover the heat exchanger coil;

a base;

a first bracket configured to receive the first header and to couple the heat exchanger coil to the base, wherein the first bracket comprises a recessed member having an opening;

a second bracket configured to couple the heat exchanger coil to the shroud via a first fastener, wherein the second bracket comprises a protruding member;

a third bracket configured to receive the second header and to couple the heat exchanger coil to the base, wherein the third bracket comprises a fastening tab and a stabilizing member; and a fourth bracket configured to couple the heat exchanger coil to the shroud via a second fastener, wherein the fourth bracket comprises a protruding ridge having a securement member and an extension member; and wherein the opening of the recessed member of the first bracket is configured to slidably receive the protruding member of the second bracket such that the first bracket and the second bracket are coupled to one another, and wherein the fastening tab of the third bracket is configured to receive the securement member of the fourth bracket via a friction fit and the extension member of the fourth bracket is configured to be clamped between the fastening tab and the stabilizing member to couple the third bracket and the fourth bracket to one another.

16. The heat exchanger of claim 15, wherein the first and third brackets each comprise plastic and the second and fourth brackets each comprise a metal.

17. A heat exchanger, comprising:

a heat exchanger coil comprising a first header and a second header;

a shroud configured to cover the heat exchanger coil;

a first bracket configured to receive the first header or the second header in a primary recess, wherein the first bracket comprises a first end and a second end opposite the first end with respect to a first length of the first bracket, the first end includes a first recessed member having a first opening, the second end includes a second recessed member having a second opening, and the first bracket includes a fastening tab disposed between the first end and the second end along the first length; and a second bracket configured to couple to the first bracket and to the shroud, wherein the second bracket comprises a third end and a fourth end opposite the third end with respect to a second length of the second bracket, a base extending along the second length, and a protruding ridge extending from the base and along the second length, wherein the third end includes a first protruding member offset from the base with respect to an axis defining the second length, and wherein the fourth end includes a second protruding member offset from the base with respect to the axis defining the second length; and wherein the fastening tab is configured to engage the protruding ridge via a friction fit in a first configuration, and wherein the first opening of the first recessed member is configured to receive the first protruding member and the second opening of the second recessed member is configured to receive the second protruding member in a second configuration, wherein, in the second configuration, a gap is formed between the base of the second bracket, the first recessed member, and the second recessed member, and wherein the first and second brackets are configured to couple the heat exchanger coil to the shroud.

18. The heat exchanger of claim 17, wherein the first bracket comprises plastic and the second bracket comprises a metal.

* * * * *